US005964043A

United States Patent [19]

Oughton et al.

[11] Patent Number: 5,964,043

[45] **Date of Patent: *Oct. 12, 1999**

[54] FREEZE-DRYING PROCESS AND APPARATUS

[75] Inventors: Dominic M. A. Oughton, Charlsworth; Philip R. J. Smith, Cambridge; Donald B. A. MacMichael, Hitchin, all of United Kingdom

[73] Assignee: Glaxo Wellcome Inc., Research Triangle Park, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/913,408

[22] PCT Filed: Mar. 14, 1996

[86] PCT No.: PCT/GB96/00597

§ 371 Date: Nov. 17, 1997

§ 102(e) Date: Nov. 17, 1997

[87] PCT Pub. No.: WO96/29556

PCT Pub. Date: Sep. 26, 1996

[30] Foreign Application Priority Data

Mar. 18, 1995 [DE] Germany ..... 95 05 523

[51] Int. Cl.[6] ..... F26B 13/30

[52] U.S. Cl. ..... 34/92; 34/284; 34/290; 34/297; 62/345; 62/381

[58] Field of Search ..... 62/345, 381; 34/284, 34/287, 289, 290, 292, 297, 92

[56] References Cited

U.S. PATENT DOCUMENTS

| | | | |
|---|---|---|---|
| 2,445,120 | 7/1948 | Levinson et al. | 34/245 |
| 2,803,888 | 8/1957 | Cerletti | 34/62 |
| 3,195,547 | 7/1965 | Rieutord | 134/163 |
| 3,203,108 | 8/1965 | Broadwin | 34/58 |
| 3,769,717 | 11/1973 | Lorentzen et al. | 34/92 |
| 3,952,541 | 4/1976 | Rigoli | 62/381 |
| 4,139,992 | 2/1979 | Fraser | 62/345 |
| 4,351,158 | 9/1982 | Hurwitz et al. | 62/60 |
| 5,609,819 | 3/1997 | Shimizu et al.. | 422/3 |

FOREIGN PATENT DOCUMENTS

| | | |
|---|---|---|
| 0 048 194 | 3/1982 | European Pat. Off. . |
| 1259127 | 6/1960 | France . |
| 967120 | 10/1957 | Germany . |
| 748784 | 5/1956 | United Kingdom . |
| 861082 | 2/1961 | United Kingdom . |
| 1199285 | 7/1970 | United Kingdom . |
| 1318043 | 5/1973 | United Kingdom . |
| 1370683 | 10/1974 | United Kingdom . |
| 1423353 | 2/1976 | United Kingdom . |

*Primary Examiner*—Henry Bennett
*Assistant Examiner*—Pamela A. Wilson
*Attorney, Agent, or Firm*—Nixon & Vanderhye PC

[57] ABSTRACT

A process and apparatus for freeze drying of liquid material in a vessel in which the vessels are moved automatically through various stages including loading vessels onto racks, washing vessels in an inverted position, sterilizing vessels and racks, filling vessels with a liquid material, rotating the vessels and the liquid material contained within each vessel at a speed that allows the liquid to form a shell against the inner surface of the vessel, subjecting the vessels and the liquid material contained therein to freezing conditions sufficient to freeze the material into the form of a shell and then moving the rack and the vessels containing the frozen material through a vacuum drying chamber in which the frozen liquid material is dried.

34 Claims, 14 Drawing Sheets

FREEZE-DRYING PROCESS AND APPARATUS

This application is the national phase of International Application PCT/GB96/00597, filed Mar. 14, 1996, which designated the U.S.

The present invention relates to a novel freeze-drying (lyophilisacion) process. This process is particularly advantageous for freeze-drying pharmaceutical products. The invention also includes the lyophilised products produced by the process.

Freeze-drying or lyophilisation, is used generally to increase the stability and hence storage life of materials. As such it is particularly useful where a material is known to be unstable or less stable in aqueous solution, as is often the case with pharmaceutical materials.

In its simplest form freeze-drying consists of freezing the aqueous material in a vial and then subjecting the material to a vacuum and drying.

The conventional method of freeze-drying is to load magazines full of vials onto chilled shelves in a sealed freeze-drying chamber. The shelf temperature is then reduced to freeze the product. At the end of the freezing period, the aqueous material is frozen as a plug at the bottom of the vial. The pressure in the chamber is then reduced and simultaneously the shelves are heated thereby causing the frozen water to sublime leaving a freeze-dried plug in the bottom of the vial (FIG. 4A). The whole lyophilisation cycle normally can take 20 to 60 hours, depending on the product and size of vial.

The disadvantages of this conventional method are as follows:

a) the time taken to freeze-dry a product;

b) the freeze-drying process is batch rather than continuous;

c) except in very sophisticated automated installations, there must necessarily be human operators to load the trays of vials into the freeze-drying chamber, which leaves the product open to contamination;

d) the process is energy intensive when the power consumption of the clean room is taken into account;

e) the freeze-drying apparatus is very expensive and takes up a large area of space, which is necessarily very expensive because it must be maintained clean or sterile to a high standard; and f) the vials are subjected to a number of discontinuous handling operations such as high-speed in line filling, transfer to holding tables, and transfer to and from trays.

These operations risk vial damage or contamination, create particles in the clean area, and require operator supervision.

European patent EP-A-0048194 discloses a method of "shell-freezing" material such that the resulting lyophilised product forms a relatively thin coat or "shell" in the vial. In this method, the aqueous material is placed a vial which is then rotated slowly on its side in a freezing bath. The shell-frozen product is then loaded into a conventional lyophilisation chamber and dried over a six hour cycle (page 7).

However, although this method allegedly results in a "shell frozen" material, distribution can be non-uniform. Also relatively long lyophilisation times may still be required. The above rolling method also suffers from other disadvantages, including:

a) it limits the amount of liquid that can be placed in the vial since above a certain limit some liquid would pour out;

b) there is a risk of spillage in any event during the rolling process;

c) rolling in a liquid coolant may result in contamination by the coolant;

d) such a rolling process may result in a less uniform shell (giving a longer drying time); and e) a rolling process may result in a longer freezing time (compared to the present invention).

U.S. Pat. No. 3,952,541 describes an apparatus for a freezing aqueous solution or suspension which comprises a refrigerated tank which has at least one plate, which carries the materials to be frozen, mounted on a shaft to rotate at about 10 to 20 revolutions per minute around the base of the tank. The tank is adjustable to tilt at (for example) a 45° angle, and a fan mounted inside the roof of the tank blows cold air around the refrigerated tank. Once the product is frozen, it appears that the vials would have to be transferred to a separate drying chamber, for approximately 11½ hours. The whole lyophilisation cycle takes 12 hours and the product obtained is of an internally concave paraboloid form.

The disadvantages of this process is that the time is still long (12 hours), the process must be operated batchwise and it is not capable of handling a large throughput of vials. Furthermore, when transferring the frozen open product from the refrigerated tank to a drying chamber, there must apparently be human operator contact and the product must be maintained in a frozen stage until transferred.

British patent no. 784784 discloses a freeze-drying process in which vessels containing liquid material are subjected to a centrifugal force at a low vacuum. The low vacuum causes the water to be released and the effect of centrifuging helps suppress the formation of bubbles and froth as the liquid boils under reduced pressure. Both this step and the drying step involve subjecting the vessel to traumatic operations which can cause particles in the clean area of the process, and disrupt the final product.

DE-C-967120 relates to a continuous freeze-drying process. Each vial is carried in a guide capsule where it is rotated rapidly under vacuum conditions to freeze the substance in the vial. Thereafter the guide capsule releases the vial into a drying chamber and returns to collect another vial. The drying chamber is composed of a long winding heated conduit in which the vials are rolled down under gravity in abutting fashion. Disadvantages of this process, however, is firstly that the vials undergo a very traumatic journey in the drying chamber and will bang together generating contaminating particles and disrupting the frozen product. Secondly, the throughput of the process is limited in that only one vial at a time can enter the drying chamber when another vial exits. Thirdly as the guide capsules are continually recycled, they can result in a source of contamination.

In U.S. Pat. No. 3,203,108, liquid in a vial is frozen into the form of a shell by rotating the vial at high speed. However the heater for drying the product is attached to the spinner. Therefore both the freezing and drying operations take place within the same chamber which limits the throughput of the process.

In FR-A-1259207 a bottle containing a liquid is rotated quickly under vacuum, and the liquid frozen as a shell. There is no mention of how or where the product is subsequently dried.

In U.S. Pat. No. 3,195,547 a bottle containing liquid is rotated quickly in a bath of freezing liquid thereby freezing the liquid in the bottle as a shell. There is no mention of how or where the product is subsequently dried.

In U.S. Pat. No. 2,445,12 a series of containers with a shell of frozen material are received into drying cabinets which emit infra-red rays to dry the shell of frozen material. The drying cabinets are housed in a dryer and the process is batch process in that the whole dryer must be loaded and unloaded after drying. This limits the throughput of the dryer.

Further freeze-drying processes are described in British patent nos. 1199285 and 1370683, and U.S. Pat. No. 3,769,717.

It is an object of the present invention to obviate or mitigate at least some of the aforesaid disadvantages.

It is a further object of the invention to provide a lyophilisation process and apparatus with shorter cycle times than the aforementioned prior process and apparatus.

It is yet a further object of the invention to provide lyophilisation apparatus which can be housed in a smaller space than the conventional freeze-drying apparatus and preferably also negates the need for human operator contact at critical parts of the process so as to minimise human contamination of the product.

According to a first aspect of the present invention there is provided a process for carrying out freeze-drying which includes a freezing step of rotating about the longitudinal axis the vessel containing the liquid material to be freeze-dried at a speed not less than that require to maintain the liquid in a shell of substantially uniform thickness against the inner walls of the vessel by the action of centrifugal force while subjecting the liquid material to freezing conditions sufficient to freeze the liquid material into the form of said shell.

Preferably the vials are rotated about their axes while held in the substantially horizontal position. This aids the achievement of an even distribution of liquid around the interior of the vessel.

The apparatus for carrying out the process of the first aspect of the invention, forms the second aspect of the invention. Accordingly there is provided apparatus for quick freezing of a liquid material contained in a sterilised vessel for subsequent crying in such a manner that said liquid material forms a shell of substantially uniform thickness on the inner walls of said vessel; said apparatus comprising: rotatable gripping means for holding the vessel and rotating it about its longitudinal axis and capable of rotating at high speeds so as to maintain the liquid material against the inner walls of the vessel by centrifugal force; filling means for introducing the liquid material into the vessel; freezing means for freezing the liquid in the form of a shell of substantially uniform thickness against the inner walls of the vessel; and conveying means to move the next vessel or vessels into position for filling and freezing.

By gripping means we mean a means to hold the vessel steadfast while it is rotated about its longitudinal axis.

Preferably the liquid material is aqueous. By aqueous material we mean aqueous solutions, suspension or the like preferably of pharmaceutical products such as antibiotics vaccine, organic chemical drugs, enzymes or serum. The invention, however, can be used for freeze-drying material dissolved or suspended in a solvent other than water.

By substantially uniform thickness of shell we mean whereby the thickness varies less than about 5% of the average thickness from the upper to the lower and of the vessel. By this we mean to include the average thickness of the shell measured at the mid-point between any local peaks or troughs in the shell surface caused by e.g. fluid dynamic interactions between the liquid and freezing gas during the freezing process.

The invention (of the first and second aspects) can be applied to large vessels of liquid material, but preferably the vessels are vials or other such small vessels, such as about 10 to 40 mm in diameter and a plurality of these vials are filled and frozen simultaneously. This is the type of vessel used in the pharmaceutical industry to carry at least one unit dose of drug. The drug is then reconstituted with water before administering to the patient.

The uniformity of the shell thickness is a function of the angle of the vessel and the speed of rotation. It is preferable to rotate the vessel up to about 45° off the horizontal, most preferably in a substantially horizontal position.

When the liquid material is introduced to the vessel while it is simultaneously rotating substantially about the horizontal (or up to about 45° off the horizontal), a shell frozen product is obtained with substantially no frozen product on the base of the vessel. This appears to be the first time that this type of shell has been achieved, and it forms a third aspect of the invention. All shell dried product obtainable by the process and apparatus of the inventions also form this further aspect of the invention.

The speed of rotation of the vessel should be controlled to maintain the liquid material in a shell on the inner walls of the vessel by the action of centrifugal force. If the speed of rotation is too low the liquid material will not be held as a shell on the walls of the vessel. The speed of rotation is a design consideration depending on the density of the liquid material to be frozen and the size of the vessel and preferably about 2500 to 3500 revolutions per minute. Typically it will be about 3000 revolutions per minute for a vial of about 10 to 40 mm diameter.

It has also been found that if the liquid material is advantageously introduced into the vessel while it is simultaneously rotating at an angle at or near the horizontal, then a greater quantity of material can be introduced. That is, if a greater than the normal "fill" quantity of material is introduced when the vessel is stationary and horizontal, some material will run out. This is less likely to happen if the vessel is simultaneously rotating when it is filled.

The liquid material is frozen into the form of a shell by subjecting it to freezing conditions. In one preferred embodiment of the invention this is achieved by injecting a controlled flow of freezing inert gas such as nitrogen into the vessel while it is simultaneously rotating the vessel. The flow of freezing gas is controlled in the sense that if injected at too high a pressure it may disrupt the shell of aqueous material or may cause it to overflow.

Injecting freezing gas into the interior of the rotating vessel has the advantage of speeding up the freezing step. Freezing gas could also, however, be circulated around the outside of the vessel, but with such a process it is important to minimise the points of contact between the gripping means and outer walls of the vessel so as to minimise any insulation of the liquid material by such contact.

The method of the present invention readily lends itself to incorporation in a continuous or semi-continuous freeze drying process. In such a process the vessels are held in racks or magazines and are moved automatically through the various stages up to and including being subjected to the vacuum drying conditions.

A process for carrying out freeze-drying according to the first aspect of the invention includes a freezing step, said process including the following steps:

a) loading one or more racks or magazines with the vessels to be filled;

b) washing the vessels, and racks or magazines;

c) sterilising the vessels, and racks or magazines;

d) filling the vessel with the liquid material to be frozen;

e) freezing the liquid material according to the first aspect of the invention;

f) subjecting the vessels containing the frozen material to vacuum conditions;

g) drying the frozen material;

h) plugging the vessels; and i) unloading the vessel and optionally capping and labelling the vessels.

In steps a) to c) and optionally in steps f) to h), the vessels can optionally be held in an inverted position e.g. in the racks or magazines. The vessels must be inverted in step b) so that washing water will drain. Furthermore, in a preferred embodiment of the invention where the vessels are held by the base and gas injected in through their open necks, then having the vessels already inverted at step c) saves an additional handling step.

It will be readily appreciated that the vessels could be unloaded prior to plugging.

A fourth aspect of the invention relates to the process for drying a shell dried material, and the fifth aspect relates to the apparatus for carrying out this drying operation.

Accordingly in a fourth aspect of the invention there is provided a process for freeze-drying a liquid material frozen in the form of a shell on the inner walls of the body of a vessel, which includes the drying step of applying heat for a time interval radially inwardly from a heating means to the shell in a vacuum chamber over a substantial surface area other shell so as to dry the shell frozen material.

In a fifth aspect of the invention there is provided apparatus for drying a liquid material frozen in the form of a shell on the inner walls of the body of a vessel, said apparatus comprising:

a vacuum chamber, heating means within the vacuum chamber designed to direct heat radially inwardly from the heating means to the shell frozen material, and conveying means to convey the vessel through the vacuum chamber.

The advantage of heating the vessel radially inwards from the heating means is that the drying cycle time is greatly reduced as compared with conventionally drying methods. Here the base of the vessel is heated, such as on a heated shelf, and the heat transfer is axially upwards through the glass walls of the vessel. This causes a temperature differential along the length of the vessel walls, thereby causing a 'drying front' in the shell frozen material. As a result the drying cycle time is typically 30 hours for plug-frozen material compared to a drying cycle time in accordance with the invention of 3 hours.

Preferably the heating means is in close proximity to the wall of the vessel, such as 5 mm or less, advantageously 3 mm or less. In a preferred embodiment of the invention (heating blocks) the distance between the wall of the vessel and the heating means is about 1 mm.

Preferably also the heating means extends round substantially the whole circumference of the vessel, and advantageously also extends substantially to the same height as the shell. In a particularly preferred embodiment the heating means includes a heating chamber into which the vessel is received.

Since the drying time is greatly reduced, the throughput of the vacuum drier is increased. Therefore a similar production capacity can be achieved with a much smaller vacuum drier than that used conventionally.

It will be appreciated that although the first, second or the fourth and fifth aspects of the invention can be used independently with conventional freezing or drying apparatus, it is advantageous to use them together. Thus as a consequence of the decreased freezing time achieved by the first and second aspects of the invention together with the decreased drying time of the fourth and fifth aspects of the invention, the production capacity of the conventional freeze-drying apparatus can be achieved with much smaller apparatus according to the invention. In fact the apparatus of the invention can be mobile, whereas conventional freeze-drying apparatus is much too large and bulky to be mobile. With all the aspects of the invention used together, an automated continuous or semi-continuous process can also be designed with minimal or no human operator contact. In this respect the conveying means is preferably the arrangement of rollers described hereafter. The magazine is also preferably of the design defined in the sixth aspect of the invention Accordingly in a sixth aspect of the invention there is provided a magazine comprising a magazine comprising a tray having an upper and lower surface and having equispaced location apertures extending through the tray for locating the necks of the vials, each set of at least three locating apertures defining an area therebetween in which an air flow aperture has been cut away, and one or more abutments adjacent each aperture which trace the circumference of the base of a vessel about the vertical axis of the locating aperture to form a locating flange on which the vessel can be located in the upright position.

Preferably the location apertures are arranged in rows and columns and each set of four location apertures define substantially the corners of a square, in which an airflow aperture is provided.

All aspects of the invention will now be described by way of example with reference to the following drawings, in which.

Figure 1:
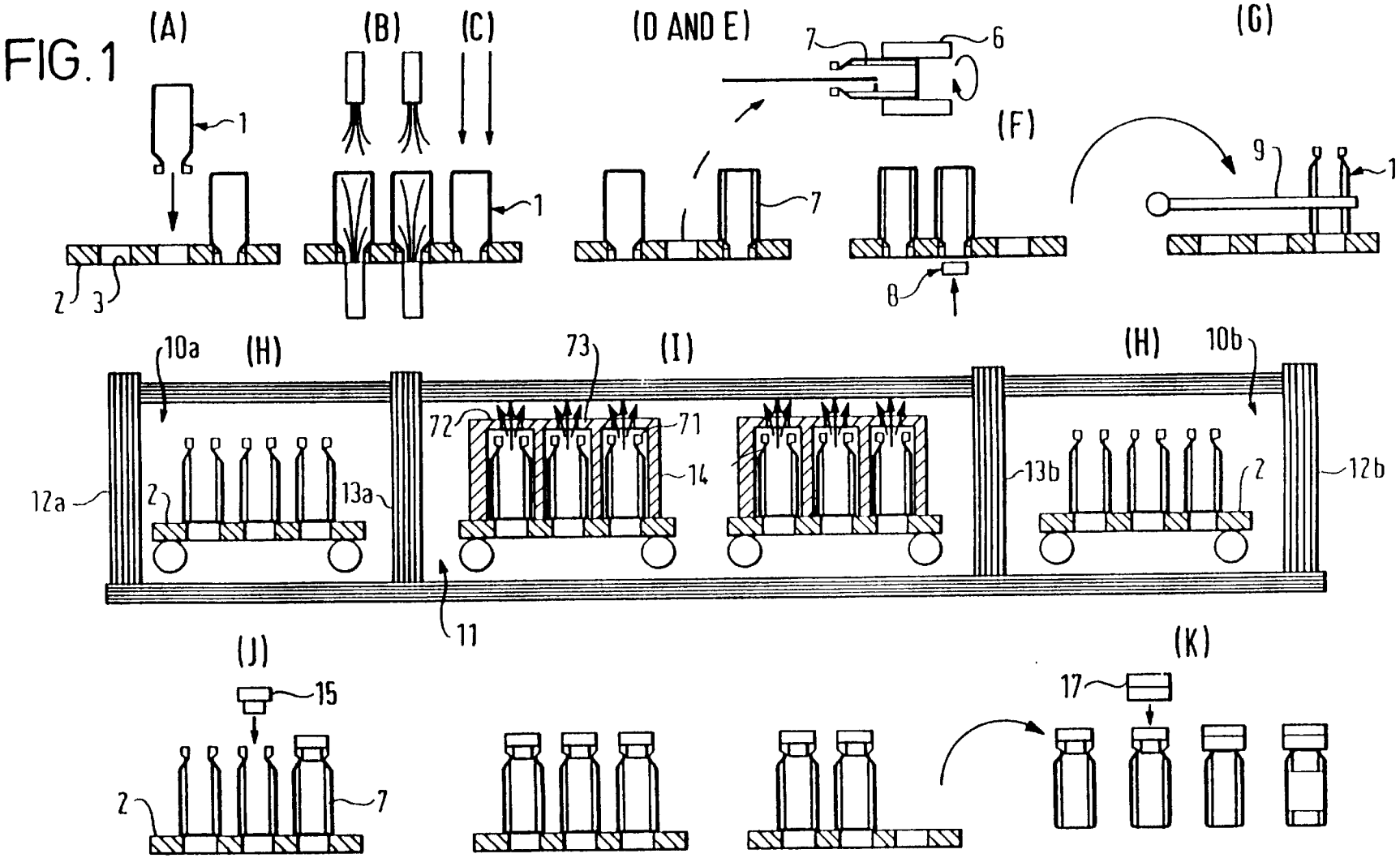
FIG. 1 is a schematic cross-sectional side view showing the series of steps carried out in the continuous lyophilisation process of the invention, including the filling and freezing of aqueous material in a vial carried in a magazine and the drying of the material.
Figure 2:
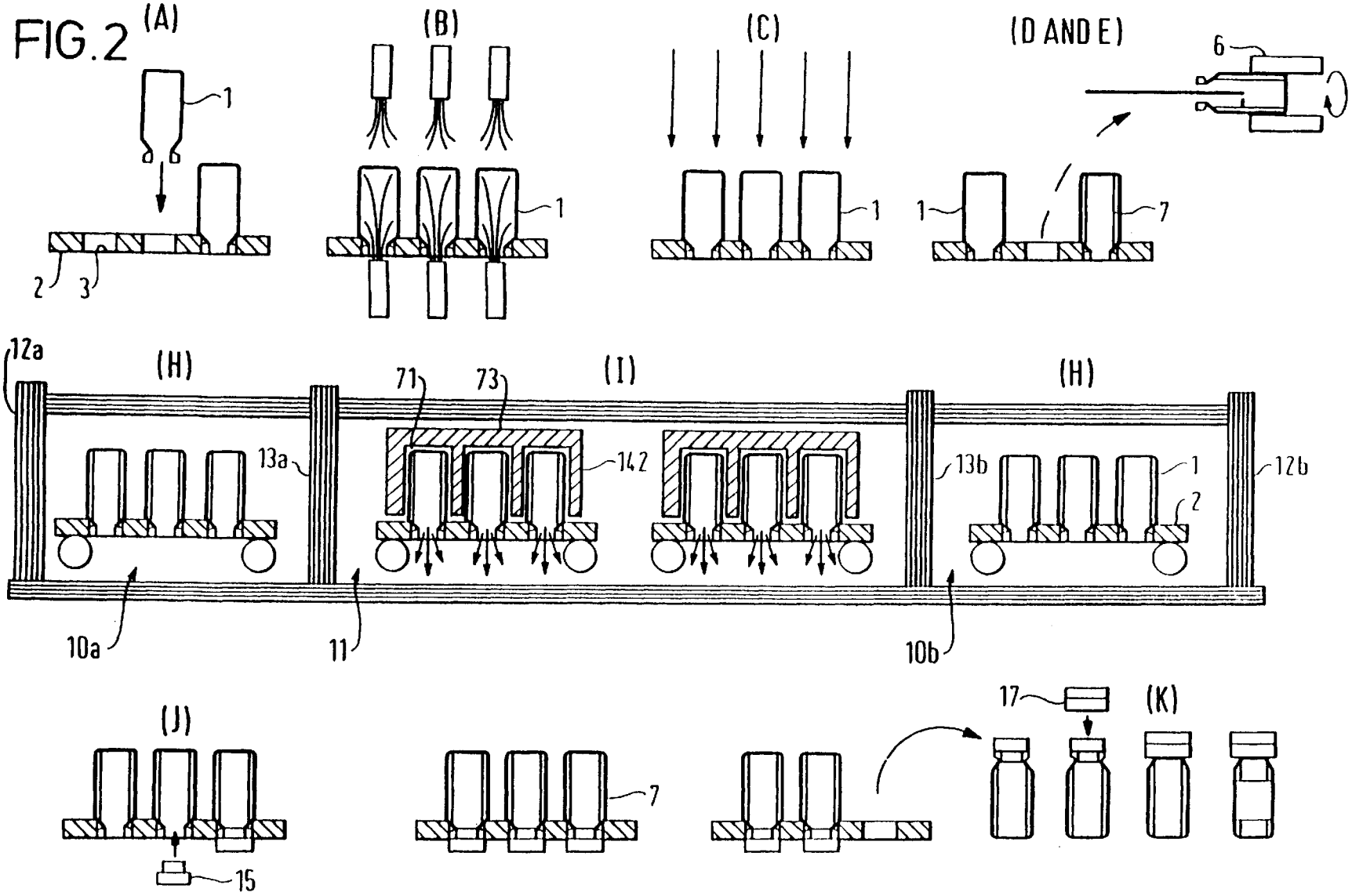
FIG. 2 is a schematic cross-sectional side view showing another embodiment of the process of the invention.

Referring to the process of FIGS. 1 and 2, the steps of an embodiment- of the process and apparatus of the invention are as follows below.

Loading step (A): Vials (1) are loaded upside-down into a magazine (2), such that the neck of each vial locates in an aperture (3) of the magazine (2). This loading step (A) takes place in a non-sterile environment and the vials (1) can be manually or automatically loaded. The vial (1) are carried through the whole process in the magazine (2), which is in turn carried through the process on conveyor means in the form of roller conveyors (not shown in FIGS. 1 and 2, but shown in FIG. 7). This is different from prior freeze-drying processes where the vials are placed loosely on metal trays. The specifically designed magazines (2) are shown more particularly in FIGS. 5 to 7.

Washing step (B) and sterilizing step (C) The vials (1) are then washed both inside and outside by injecting washing solution into the inverted vials (1) through their necks and spraying washing solution onto the outside of the vials (1). The vials (1) are then hot air sterilized (Step C) by passing them into a sterilizing chamber (4—see FIG. 3)) where hot air is blown onto the vials (1). The sterilized magazines (2) full of vials (1) are then carried by the conveying means onto a Fill-Spin-Freeze (FSF) section (5) where the filling (D) and freezing (E) steps take place. The apparatus for carrying out these steps is shown more particularly in FIGS. 8 to 16.

Filling step (D) and Freezing step (E): In a filling and freezing operation, the vials (1) and magazines (2) enter the FSF section (5) and are allowed to cool to the FSF internal temperature (typically about −50° C.). Vials (1) are removed from the magazines (2) one row at a time, (or feasibly two rows at a time) these being picked up by a robot arm (not shown in FIGS. 1 and 2) carrying a plurality of rotatable gripping means in the form of multi-fingered gripper (6). The vials (1) are rotated to horizontal and the robot arm swings 90° to the side of the FSF chamber. The vials (1) are rapidly rotated and filled with the required dose of aqueous material, particularly a drug material such as a vaccine. Optionally the vials may be firstly filled then spun, but preferably the filling occurs while simultaneously spinning the vial (1) The speed of rotation or spinning should be not less than that required to maintain the aqueous material in a shell (7) of substantially uniform thickness against the inner walls of the vial (1). The vials (1) are then moved over nozzles from which is blown cold gas (typically—nitrogen at about −150° C.) to expose the spinning aqueous material to freezing conditions sufficient to freeze the material into the shell (7). The frozen shell (and later the dried shell) will be of a substantially uniform thickness—i.e. the thickness of the shell measured at any position along the axis of the vial will not vary more than about 5% providing that the thickness is measured as the average between any surface peaks or troughs which may result from fluid dynamics during the freezing process. After a preset time to complete freezing, the spinning is stopped and the vials (1) returned to the magazine (2). The temperature of the interior of the enclosure is maintained sufficiently cold so that the shells do not melt.

Weighing Step (F): Whilst a row of vials (1) is being filled and frozen, other vials (1) are weighed by indexing the magazine (2) back and forward over the weigh load cells (8—FIG. 1) This allows all vials (1) to be weighed before and after filling to check the correct dosage has been dispensed. The weigh load cells (8) are shown more particularly in FIG. 16.

Turn over of vials (Step G): After filling and freezing, the vials (1) are (optionally) turned over from upside-down to the correct way up (see FIG. 1). This is achieved by picking up the vials (1) (one row at a time) from one magazine (2) and transferring them to the magazine in front. A transfer arm (9) holding sufficient grippers for a row of vials holds the vials (1) around their centre and rotates 180° about a horizontal axis across the direction of movement of the magazine (2). The vials (1) are then released the correct way up on the magazine in front (2). This optional step demands that there is always the equivalent of an empty magazine in the process, which is loaded at the start of production. In the process of FIG. 2, this turn over step does not occur and the vials are loaded inverted back into the magazine (2) before being conveyed onto the drying section of the process.

Vacuum Tunnel—Entry air Lock (Step H): Once the material in the vial (1) has been frozen, it is ready for drying. The magazine (2) enters an air lock chamber (10*a*) between the FSF chamber (4) and a vacuum drying tunnel (11). The outer door (12*a*) of the airlock (10*a*) then closes and the air pressure is reduced to the same as the vacuum tunnel (11). The inner door (13*a*) then opens and the magazine (2) enters the vacuum chamber (11). The outer door (12*a*) is then opened ready for the next magazine (2).

Figure 4A:
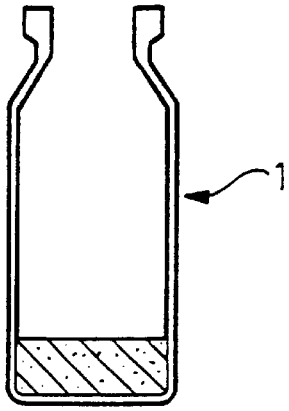
FIG. 4 is a cross-sectional view through a vial having a conventional plug of lyophilised material at its base (4A), and a vial having a shell of lyophilised material on the inner walls of the vial in accordance with the invention (4B)
Figure 4B:
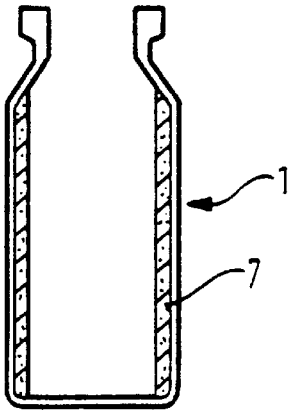

The magazines (2) in the vacuum tunnel (11) move by conveyor means in an indexing motion one complete magazine length at a time, typically every 10 mins. When the magazines (2) have been indexed to the new stations heater blocks (14) lower over the vials (1). These direct heat substantially radially inwards to the vial over substantially the whole surface area of the shell frozen material (7) and thereby provide the energy to sublime off the water and freeze dry the material (7). Immediately prior to the magazines (2) indexing the heater blocks are raised to their first position to allow the magazine (2) and vials (1) to pass underneath and move one magazine (2) length to the next heater block (14). The heater blocks (14) are each set to a different temperature, so giving the temperature profile necessary to achieve the correct drying conditions for the particular drug material being handled. The freeze-dried shell material (7) produced according to the invention is shown more clearly in FIG. 4B. The conventional plug dried product is shown in FIG. 4A.

At the end of the vacuum tunnel there is a second airlock. This works in a similar way to the input air lock, allowing the vials out whilst maintaining the vacuum in the rain tunnel.

Plugging (Step J): There are two options for plugging. One is to carry out plugging in the outlet air lock (10*b*). In this case the plugs (15) would enter the air lock (10*a*) as a magazine (2) exits. The plugs (15) would be pushed into the vials (1) before opening the outer door (12*b*); this allows plugging at any desired pressure and in any chosen gas. The second option is to plug after the air lock (10*b*) in a sterile plugging area (16) (see FIG. 3). Conventional equipment could be used here but the size of the sterile area (16) would increase as a result.

Capping (step K): The crimping of caps (17) onto the plugs (15) could use standard equipment and be carried out in a clean (but not necessarily sterile) area.

The whole freeze-drying process is operated from a central control station more particularly shown in FIG. 4.

Figure 5:
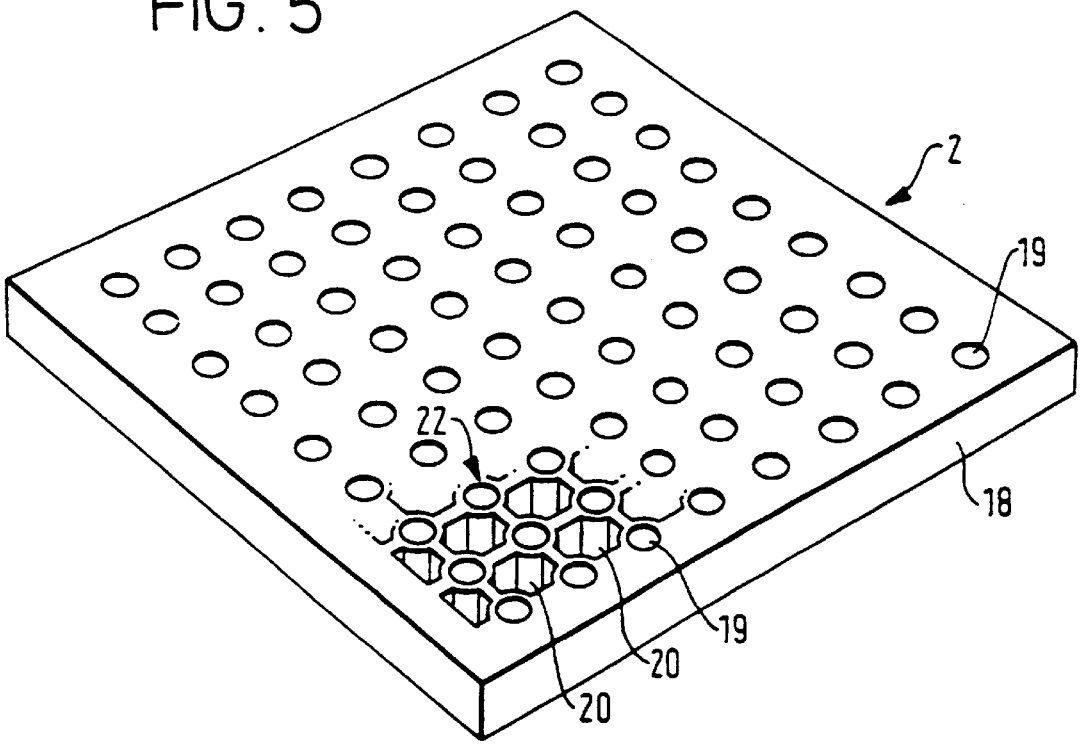
FIG. 5 is a top perspective view of a magazine used in the process of FIGS. 1 and 2.
Figure 6:
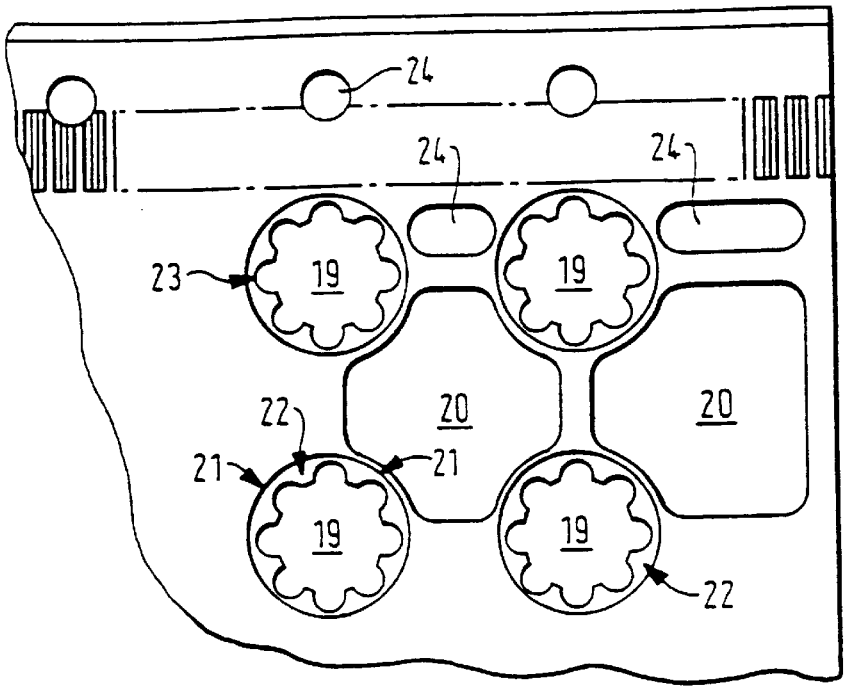
FIG. 6 is a fragmented plan view showing a corner portion of the magazine displayed in FIG. 5.
Figure 7:
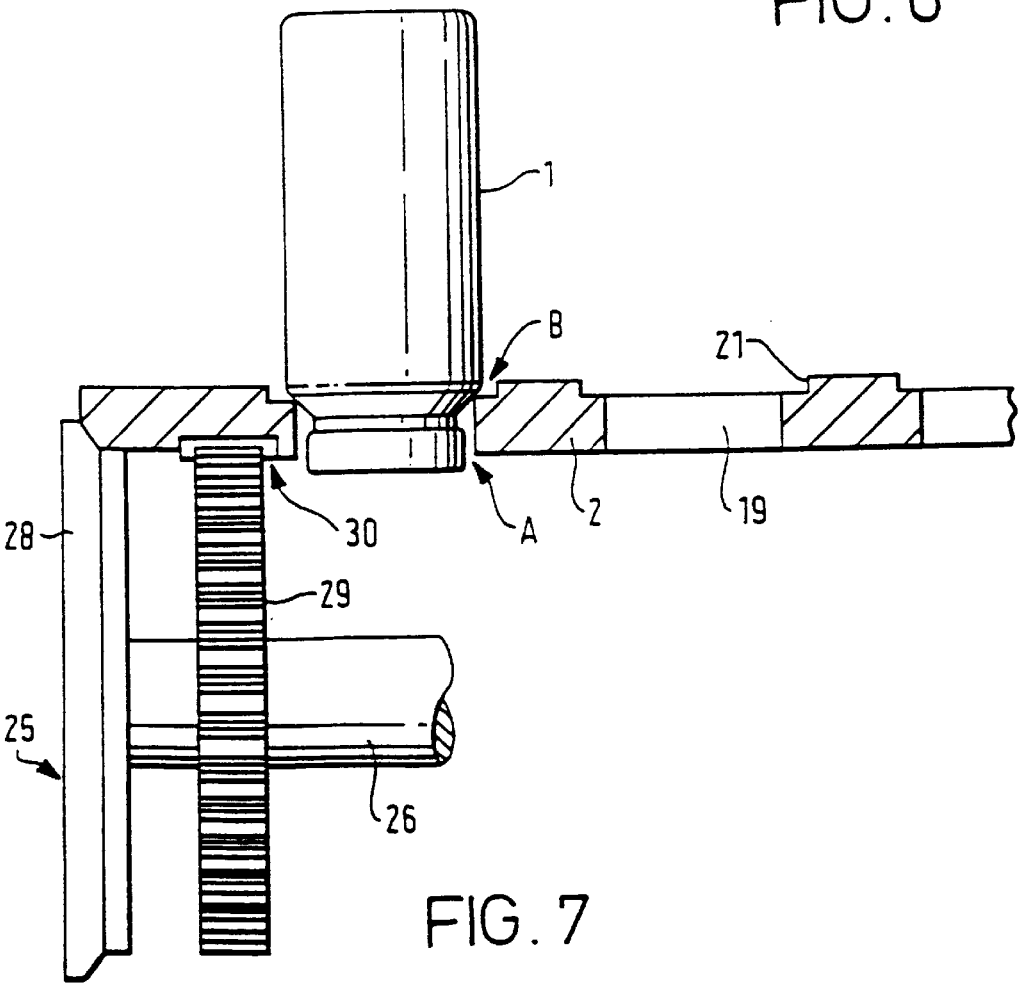
FIG. 7 is a cross-sectional view through a portion of the magazine of FIGS. 5 and 6 but showing a vial in position and a section of a roller conveyor below the magazine.

FIGS. 5 to 7 show a magazine (2) used for carrying the vials (1) through the whole freeze-drying process. The magazine (2) of FIG. 5 comprises a tray (18) having an upper and lower surface and having eight rows of eight equispaced location apertures (19) extending through the tray (18) for locating the necks of the vials. Each set of four locating apertures (19) defines the four corners of a square in which an air flow aperture (20) has been cut away. A concave abutment (21) adjacent each aperture trace the circumference of the base of a vial (1) about the vertical axis of the locating aperture (19) to form a locating flange (22) on which vial (1) can be located in the upright position.

The vials (1) are preferably held in an inverted position as shown in FIG. 7. This Figure also shows that the top surface of the vial neck preferably does not contact the magazine (2) so that any particles which may be produced by fretting between vial (1) and magazine (2) at point A are unlikely to contaminate the inside of the vial (1).

The vial is supported on its neck at point B. This design depends upon the diameter of the vial (1) being greater than the diameter of the neck of the vial.

The location aperture (19) in the magazine (2) is preferably castellated as shown in FIG. 6. The castellations (23) allow water to be jetted between vial (1) and magazine (2) during the washing process to remove any particles that may have been trapped in the gap. The open area of the air-flow aperture (20) allows the free passage of air through the magazine during hot air sterilisation and for cold laminar air flow in the FSF section (5) (see FIG. 15).

Locating holes (24) towards the outer edge of the magazine are preferably provided for precise positioning. The holes are circular on one side and elongated on the other side to allow for position location without overconstraint.

Figure 8:
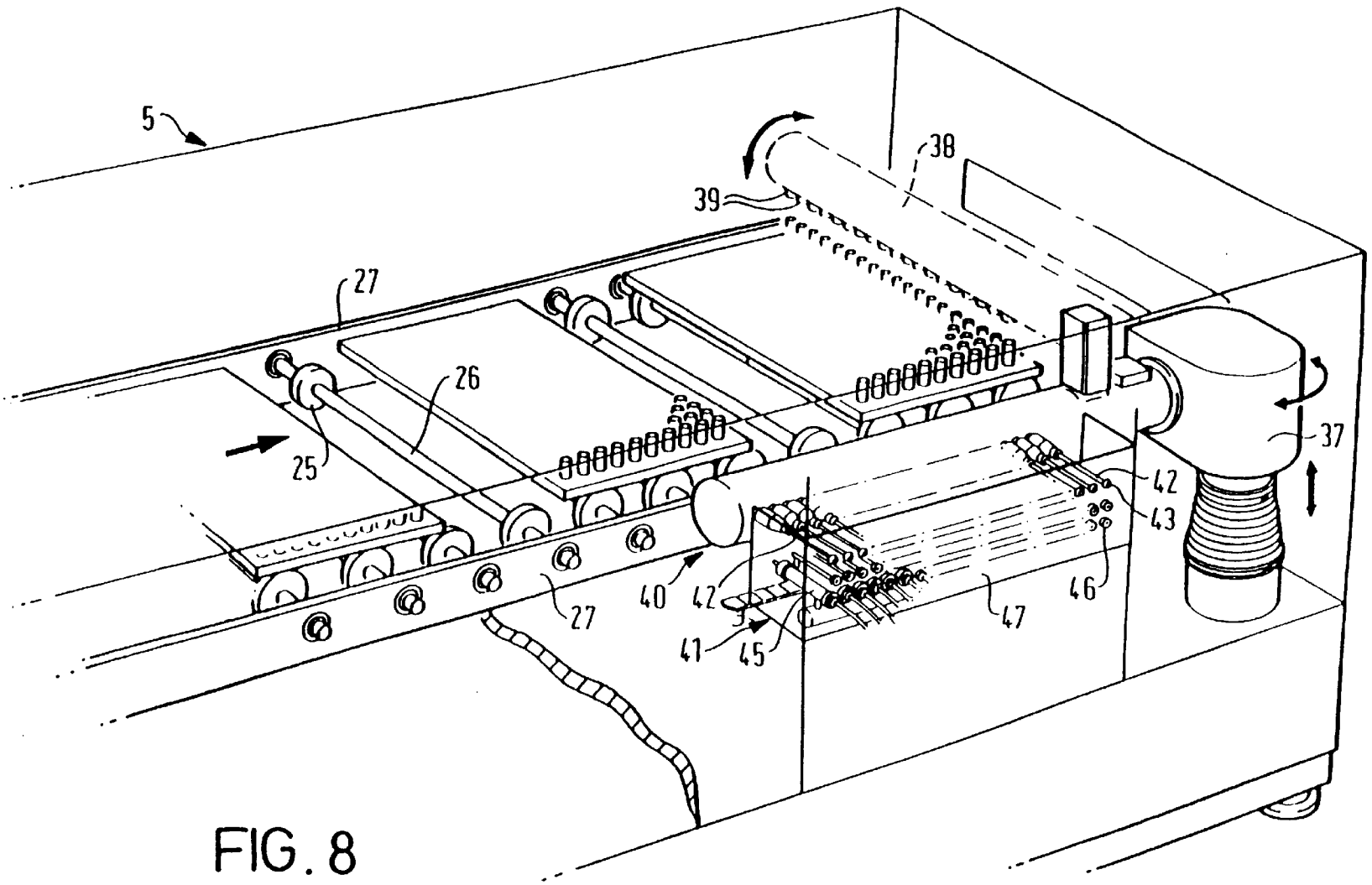
FIG. 8 is a top and side perspective view of automated apparatus including an automated arm carrying grippers for carrying out the filling and freezing steps D and E shown in FIGS. 1 and 2 (i.e. in the Fill-Spin-Freeze (FSF) chamber)
Figure 9:
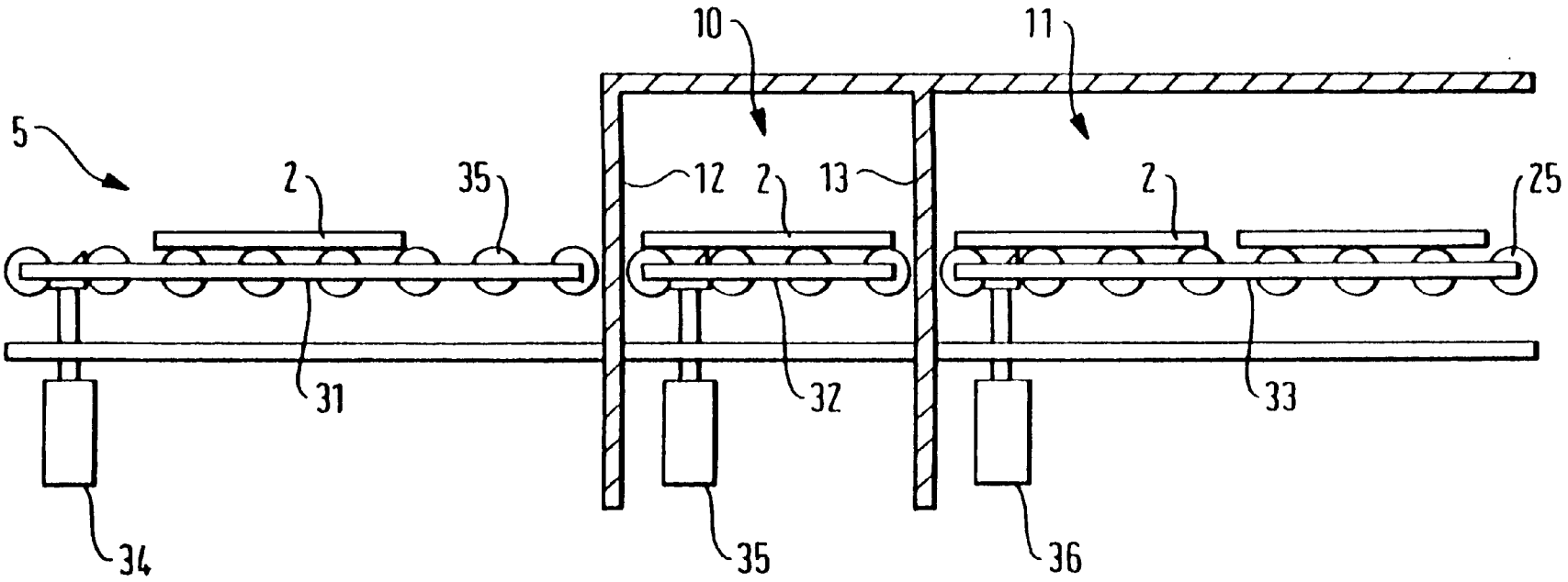
FIG. 9 is a side view of the roller conveying means for carrying the magazines and vials throughout the process.

As shown more particularly in FIGS. 8 and 9, the means for conveying the magazines through the lyophilisation process preferably comprises a plurality of parallel rollers (25) axially mounted near both ends of corresponding rotatable shafts (26) which in turn are suspended between two long parallel side supports (27). Referring to FIG. 7, each roller has an outwardly and circumferentially extending flange (28) on which the magazine rests and is moved along. Also mounted on the rotatable shaft (26) adjacent the roller is a toothed drive gear wheel (29). The underside of the magazine (2) has a rack with teeth (30) to engage with the teeth of the drive gear (29) and index the magazine (2) along.

Through the whole process the magazine (2) is supported on a series of these rollers (25), not all of which have drive teeth. Furthermore not all of the drive teeth will move at the same time, thereby giving controlled indexing of the magazine throughout the process. For example within the FSF chamber (5), the magazine (2) is preferably indexed by one row at a time, typically one row per minute. It will also move back and forward by one or two rows (as described hereafter) above the check weighing cells (8). In the drying chamber (11), however the magazine (2) is preferably indexed by a whole magazine length at a time, one index every 8 minutes for example. Therefore the rollers in the FSF chamber (5) would not be directly linked to those in the drying chamber (11). The conveying rollers are however synchronised where necessary to provide a smooth transfer between different roller sections.

FIG. 9 shows a side view of the drive roller arrangement transporting magazines (2) through the process. More particularly, the figure represents the movement from the FSF region (5) to the airlock (10) and the vacuum chamber (11) through air lock doors (12*a* and 13). In order to move a magazine from region to region, each set of rollers needs to be driven independently. The rollers (25) are connected together in groups by drive shafts (31,32,33) and are driven by independent drive motors (34, 35 and 36). Each motor (34 to 36) is position controlled by central software to provide the necessary movements and to synchronise movement between adjacent groups during magazine transfer from group to group.

The transfer of magazine (2) and vials (1) throughout the process on the preferred roller conveyor arrangement (25 to 36) of the invention has a number of advantages for use particularly in a continuous freeze-drying process. This is especially so in comparison with conventional drives which might be for example flat bed conveyors, chain link conveyors, other conveyor types or trays as used in conventional freeze drying. These are as follows:

1. There is no vial-to-vial contact. This reduces the amount of particle generation caused by fretting and reduces the chances of a vial fracture.
2. The magazine design is very open for the washing and sterilizing process. Washing is better because the exact vial location is known hence wash jets can be directed at key parts of the vial. The open spaces of the magazine allow the hot air of sterilization to pass freely through the magazine.
3. The open structure also allows good airflow in the FSF region where downwards laminar air flow is needed to maintain very low particle levels in the region of the vials. The layout of the supporting rollers is also clean and simple and hence helps air flow.
4. The magazines and rollers themselves constitute a greatly reduced source of particles in comparison with conventional conveyors which tend to have large numbers of fretting surfaces.
5. Since the magazines preferably pass through the whole process (rather than short lengths of conveyors in each section) there is only a minimum of mechanical handling of the vials. There is no need for any vial handling stage between the sterilizer and the FSF chamber for example, nor between the FSF and the drying chamber.
6. Since the magazines preferably pass through the whole process (rather than short lengths of conveyors in each section) they are repeatedly cleaned i.e. they are cleaned and sterilized on each path through, whereas a conveyor contained within any one machine element would not be cleaned and hence would have the possibility to cause vial-to-vial contamination.
7. The separate nature of the magazines allows them to pass through the air lock doors on entry to and exit from the tunnel. This is possible because the air lock (sliding) doors can be located between two parallel rollers.
8. Since each vial is located in its individual location in the magazine, the vials can be readily located when necessary e.g. for gripping for the FSF process, for heating in the drying chamber and for plugging. Conventional vial transport generally requires a separate mechanism for vial alignment prior to handling stages.

9. Since each vial is located in its individual location in the magazine it can be individually tracked through the process for development purposes or to identify a particular vial in the event of a process failure such as poor filling. A vial which is identified by the check weigh system as faulty, can therefore be subsequently retrieved at any convenient stage in the process.

Referring to FIG. 8 the magazines (2) and vials (1) are moved through the FSF chamber (S) in the direction of the arrow from the rear to the front end thereof and then into the continuous vacuum drying tunnel(consisting of the air locks (10*a*, 10*b*) and drying chamber (11)).

A robotic handler (37) is fixedly located towards the front end of the FSF chamber (S) and alongside the roller conveyor (25 to 36).

An arm (38) carrying a plurality of rotatable equispaced gripper means (39) extends perpendicularly from the upper end of the robotic handler (37) and is controlled thereby.

A filling (40) and freezing station (41) are both located in the chamber (5) alongside the roller conveyor (25 to 36) and rearwardly of the robotic handler (37). The filling station (40) consists of a row of needle nozzles (42) which each has a connector (43) for connecting outside the FSF chamber to a reservoir of the aqueous material to be lyophilized (44—see FIG. 9). The freezing station (41) also contains a row of needle nozzles (45) which also each has an adapter (46) for connecting to a supply of freezing nitrogen gas (44) also outside the FSF chamber. The nozzles (42) of the freezing station (40) are located directly below the nozzles (42) of the filling station (41) and both sets of nozzles (42,45) are mounted on a casing (47) at approximately the same height as the arm (38). The filling and gas reservoirs (44) are conveniently located outside the FSF chamber (5) so that the FSF chamber (5) can be maintained as clean as possible (see FIG. 9). The filling needles (42) are provided with either heating means or thermal insulation to prevent the liquid material freezing inside the needle (42) during filling.

Figure 11:
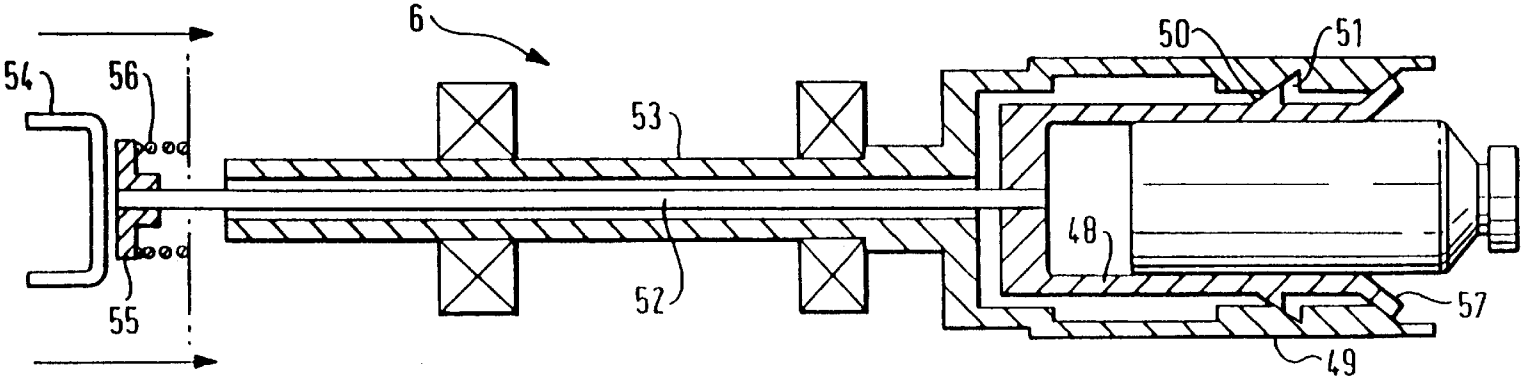
FIG. 11 is a cross-sectional view of the grippers carried by the arm (not shown) of FIG. 8.

FIG. 11 shows the rotatable vial gripper means (6) in cross-section. The vial (1) is held in concentrically moving fingers (48) which are designed to hold the vial (1) with its axis accurately concentric with the axis of rotation of the gripper (6). The fingers (48) are housed and are axially movable within an outer casing (49) and have outwardly extending projections (50) which are slidably receivable into complimentary recesses (51) in the outer casing (49) or visa versa. The vial (1) is spun to produce a shell (7) of the liquid drug inside the vial (1). The vial (1) is then transferred to a position enclosing the freezing gas nozzle to freeze the shell (7). This ensures that the frozen shell (7) has a substantially uniform wall thickness, and is an improvement over rolling while freezing. The fingers (48) are controlled by a push rod (52) extending axially along the gripper shaft (53) connected between the base of the fingers and a flange (55). The fingers are opened by the movement of an actuator frame (54) (which is mounted within the robot arm (37)) in the direction of the arrows against the flange (55) thereby compressing a spring (56) against the flange (55) and a second flange (not shown). In the open position the fingers (48) are pushed axially out of the outer casing (49) by the push rod (52) such that the projections (50) slide into the complimentary recesses (51) thereby allowing the fingers to open. In the closed position the force of the spring (56) pulls the fingers (42) axially into the casing (43) and the projections (50) slide out from the recesses (51) thereby forcing the fingers (48) to close, as with a collet. This arrangement has the advantage that in the event of power failure to the flange actuator (53), the fingers (48) will remain clamped shut. In the open position, the frame actuator (54) abuts the flange (55), but in the closed position they are spaced apart allowing free rotation of the whole gripping arrangement (6).

Each rotatable gripping means (6) is designed with a sufficient chamfered lead-in (57) that even a poorly shaped vial (1) located poorly in a magazine will still move smoothly into the gripper means (6) when it is lowered over the magazine.

Figure 12:
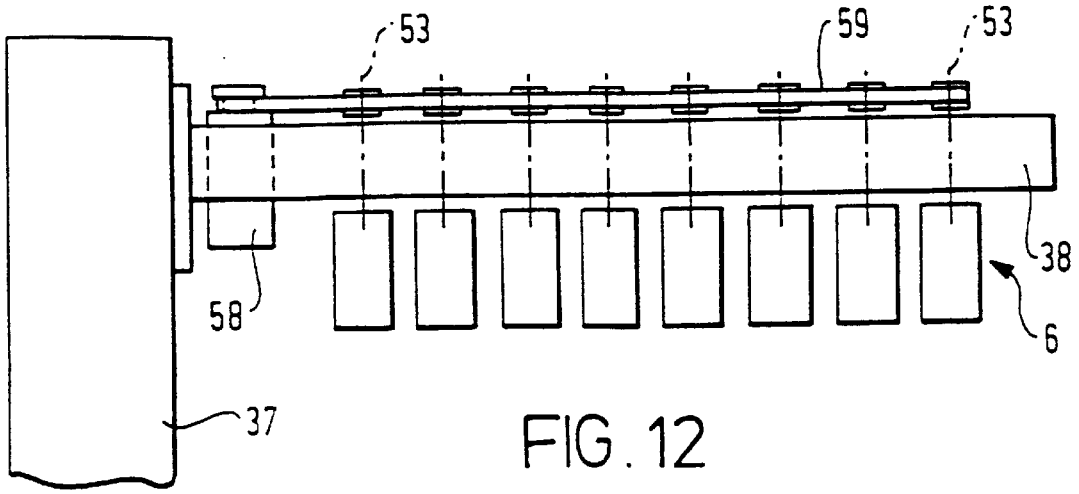
FIG. 12 is a schematic side view of the arm and grippers, but additionally showing a driving means for rotating the grippers.

FIG. 12 shows the drive arrangement (58,59) by which the gripping means (6) are all rotated. There is a single drive motor (58) linked to each gripper shaft (53) by a toothed timing belt (59).

Figure 13:
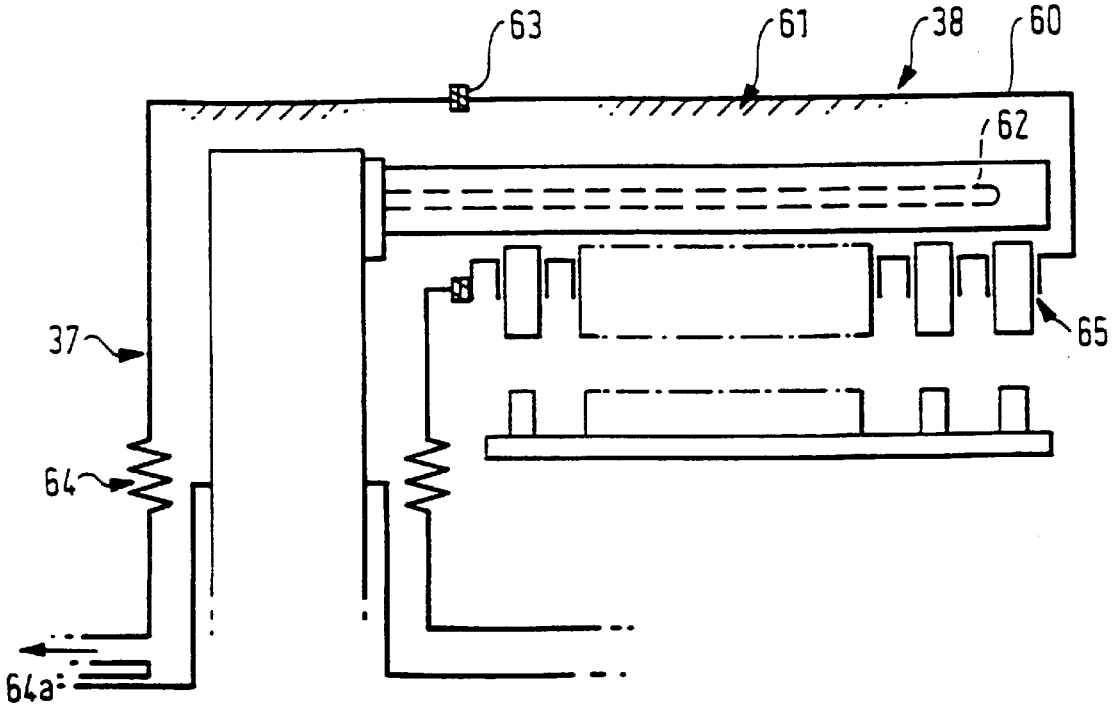
FIG. 13 is a schematic cross-sectional view of a portion of the arm and grippers.

As shown more particularly in FIG. 13, since the FSF atmosphere is at about −50° C., the robot arm (37) is covered by outer sleeve (60) which has internal insulation (61). The arm (37) is held at room temperature by thermostatically controlled heater element (62). The outer sleeve (60) contains a sliding seal (63) to allow rotation and the robot handler (37) is provided with flexible bellows (64) to allow vertical motion relative to magazine (2). This arrangement means that the insulated outer sleeve (60,61) provides thermal insulation between the cold atmosphere and the relatively warm mechanical components of the arm (38).

The outer covering (60,61) of the arm (37) serves at least two purposes.

1. To allow the arm mechanisms to operate at room temperature while the arm is mounted within the FSF enclosure.
2. To protect the clean FSF environment from any particles which are generated by movable parts such as the spinning gripper shafts (53) or the drive belt (59).

Air which is contained inside the enclosure will be extracted from the enclosure via vent aperture (64) and does not require any fan for extraction since the enclosure will be positively pressurised. This extraction will cause relatively high air velocity in the narrow aperture (65) between the spinning gripping means (6) and the outer arm casing (60), which will tend to carry any particles generated in the vicinity of the gripping means (6) together with any particles generated within the interior atmosphere of the robot arm (37) towards the vent aperture (64) and hence away from the clean area of the vials (1).

In a fill, spin, freeze cycle, the arm (37) is lowered vertically from a first position in which the gripping means (6) are disposed perpendicular to the roller conveyor (25 to 36) and spaced above the vials (1) carried thereon, and a second position in which each gripping means (6) grips the base of a vial (1) Typically one row of vials (1) are removed simultaneously from the magazine (2) The arm (37) is then raised to the first position and rotated through 90° to a third position in which the gripping means are substantially parallel to the roller conveyor (25 to 36) and the vials (1) are held substantially horizontally. The arm (37) then swings through 90° in a horizontal plane in front of the filling means so that a nozzle (42) of the filling station (40) extends in through the neck of a corresponding vial (1). The vials are then rotated at a high speed of about 3000 rpm and a measured dose of aqueous material is simultaneously injected into the vial (1), causing the material to be maintained in a shell (7) against the inner walls of the vial (1) by the action of centrifugal force. The vials (1) are then withdrawn from the nozzles (42) of the filling station (40) and the arm (38) lowered to the height of the freezing station (41) and moved towards it so that the nozzles (45) thereof are inserted into the vials (1) and a controlled jet of cold nitrogen gas (typically of a temperature of about −50° C.) is injected into the vial (1) whilst it is simultaneously rotating to freeze the aqueous material into a shell (7) against the inner walls of the vial (1). After a preset time to allow freezing (typically between 30 to 60 seconds) the rotation is stopped and the vials (1) returned to the magazine (2).

One major advantage deriving from the very short freezing cycle time is that the throughput capacity of a conventional freeze-drying apparatus can be accommodated on a much smaller scale of apparatus. As a result the process can be more easily automated and continuous thereby excluding human operators from the process and thus maximizing the sterility of the process. To achieve this, the interior of the process line must be isolated from the exterior by 'isolation technology'. This requires both a barrier to the ingress of dirt or bacteria and also means internally so that the chamber (4) can be cleaned and sterilized automatically—i.e. it must be cleared when sealed closed and it must remain sealed throughout the whole production of a batch. Therefore preferably the whole freeze-drying process of the invention is designed for reliable mechanical handling. That is if a vial (1) is dropped or is broken during the process then it is very hard to continue without an operator going inside the isolator to tidy up. If this is necessary then sterility is lost, product in the area must be discarded and the procedure for cleaning and sterilization must be repeated before production can continue. This would be a time consuming and costly delay, and hence reliable mechanisms are important.

Figure 15:
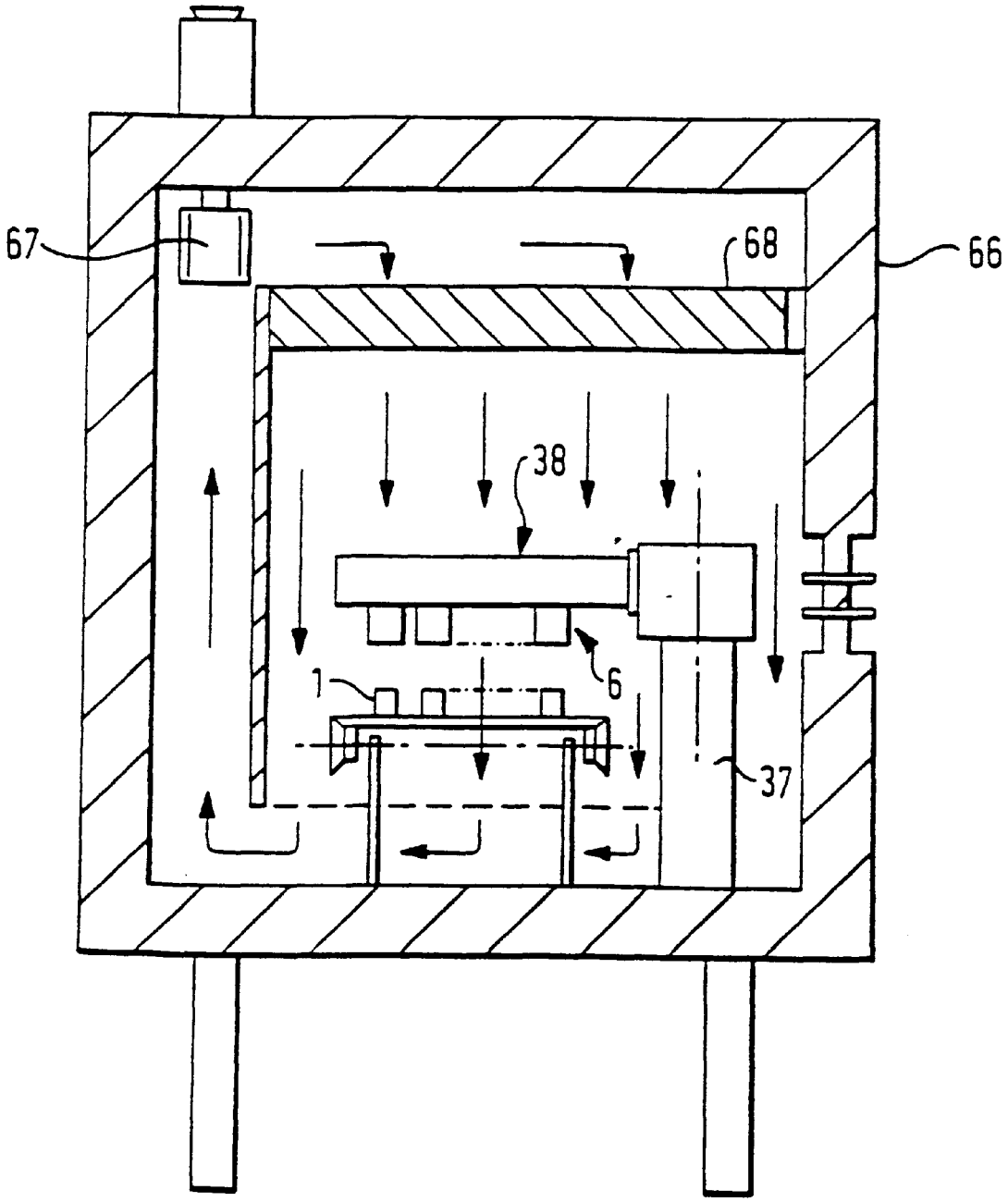
FIG. 15 is a schematic longitudinal cross-sectional view of the FSF chamber shown in FIG. 8.
Figure 17:
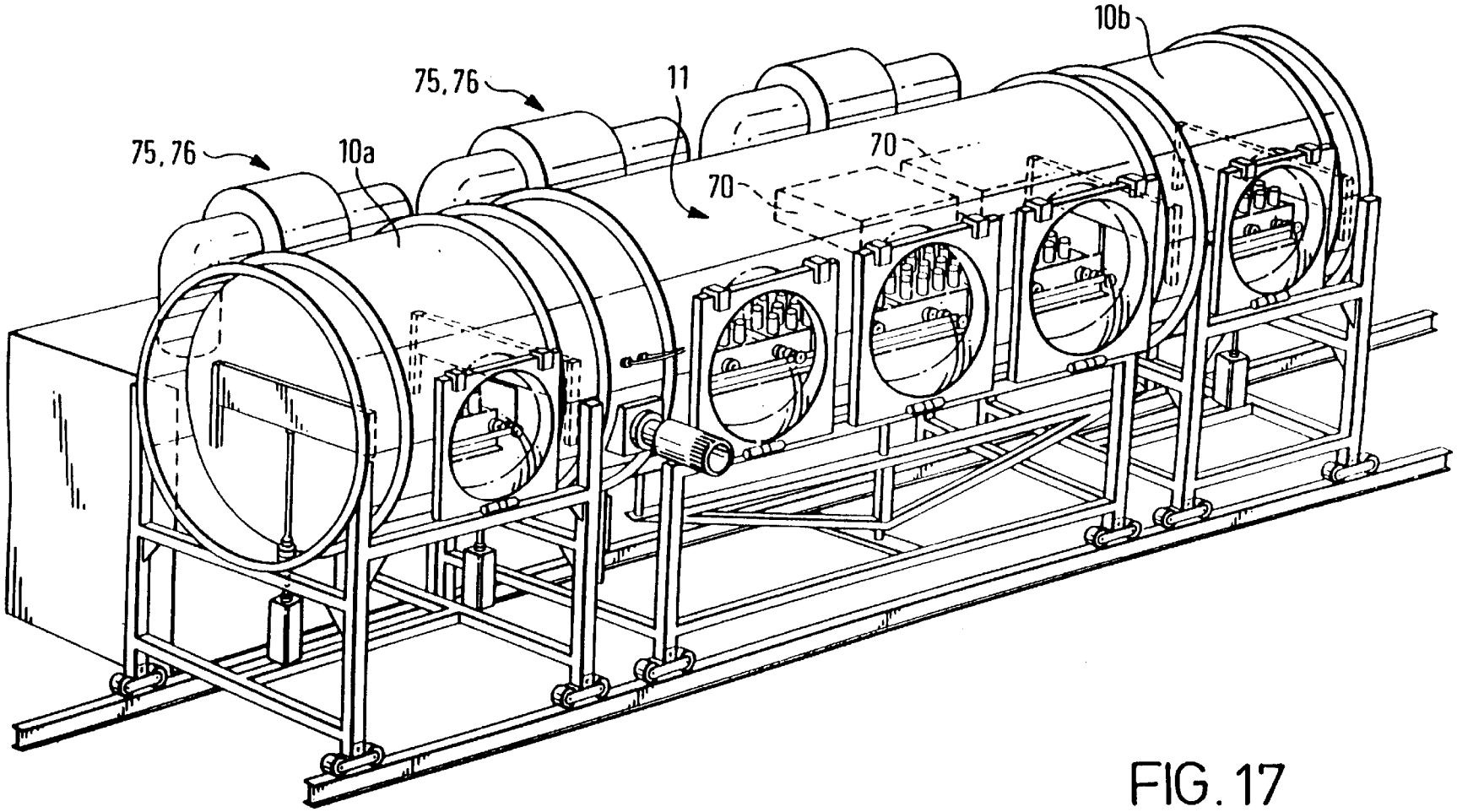
FIG. 17 is a top and side perspective view of the automated drying apparatus for the drying step (H and I) shown in FIG. 1.

FIG. 15 shows how a sterile barrier is arranged in the FSF area (5). The figure is a cross section of the production line, looking in the direction of product flow. The barrier itself (66) is shown as a thick wall because of the necessity for thermal insulation (internal temperature may be −50° C.). The internal gas is circulated round by fan (67) in the direction of the various arrows. As the air passes through filter ('HEPA' filter) (68) fine particles and micro-organisms are removed and the flow is also evened out so that the flow in the region below the filter (68) is laminar, downwards. The downwards flow of clean air ensures that the filling process and the waiting vials (1) are in clean air and that any particles shed in these or other regions are carried downwards and clear of the vials.

Figure 14:
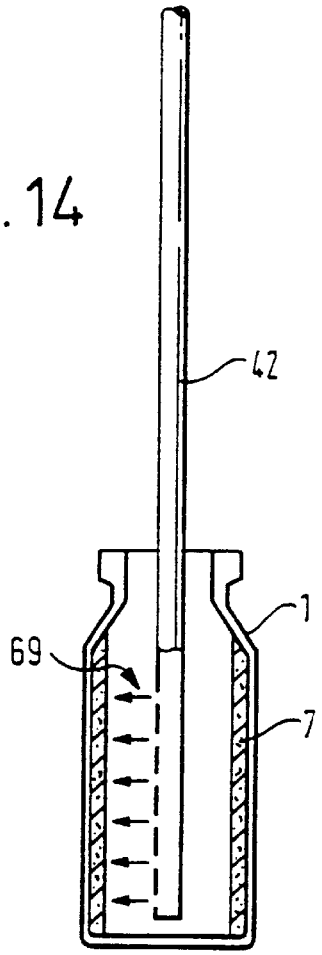
FIG. 14 is a cross-sectional view through a vial showing a nozzle inserted into the vial.

The injection of the freezing gas to form the shell is shown more particularly in FIG. 14. Preferably the freezing nozzle (42) has a plurality of ports (69) along its length through which the freezing gas is injected.

The substantially horizontal orientation of the vial (1) mitigates the problem of producing a parabolic surface to the shell and helps form a shell of substantially uniform thickness. The rate of heat transfer from gas to product is increased by increasing the temperature difference (by having colder gas) and by increasing relative velocity between gas and liquid. Very high gas velocity however will disrupt the liquid shell and cause an uneven frozen shape. The pattern of ports (69) in the side of the nozzle (42) (FIG. 14) mitigates this problem by reducing any local peaks in gas velocity.

Since the vial (1) can be simultaneously spun and filled it is possible to fill the vial beyond the limit where the aqueous material would spill over the neck if the vials were not spinning. For sensitive drugs, it may be advantageous to do the filling at a lower rotational speed than the freezing, to minimize the effect of shear.

It is advantageous to be able to weigh every vial (1) so that the weight of filled product in each vial can be checked and any process deviations noted and corrected. This means for example that if one of the filling pumps was tending to fill slightly less than target fill weight then the pump could be adjusted to keep the fill weight under control. Any total filling failure for example caused by a blockage would be instantly recognized.

Figure 16:
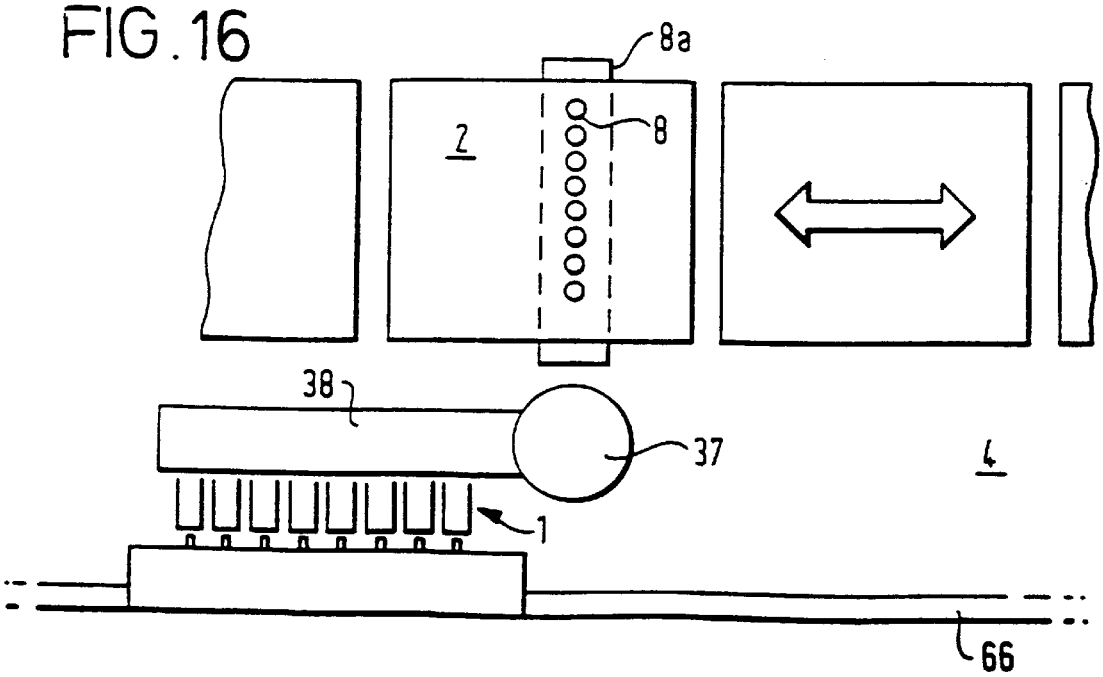
FIG. 16 is another schematic plan view of a part of the filling and freezing apparatus of FIG. 8, but additionally showing a check weigh station.

The weigh cells (8) are located in the FSF area (5) under one row of vials adjacent to the robot arm (37) (FIG. 16). The weigh cells (8) are mounted on a frame (8A) such that when the frame (8A) is raised then all the vials (1) in that row are lifted by the weigh cells (8) clear of the magazine (2) and their individual weights can be determined. The direction of magazine indexing is shown by the arrow.

The sequence of filling and weighing is as follows:

Row 1 is indexed over the weigh cells and is weighed, empty.

The robotic arm (38) then picks row 1, spin-fills and freezes it.

During this time the magazine (2) moves so that row 2 is indexed over the weigh cells (8) and is weighed, empty.

Row 1 is then returned to the magazine (2).

The robotic arm (38) then picks row 2, spin-fills and freezes it.

During this time the magazine (2) moves so that row 3 is indexed over the weigh cells (8) and is weighed, empty and then row 1 is indexed over the weigh cells (8) and is weighed, full.

Row 2 is then returned to the magazine (2).

The robotic arm (32) then picks row 3, spin-fills and freezes it.

During this time the magazine moves so that row 4 is indexed over the weigh cells (8) and is weighed, empty and then row 2 is indexed over the weigh cells (8) and is weighed, full.

Row 3 is then returned to the magazine (2). This process is repeated until all vials (1) in the magazine (2) have been weighed and filled. The next magazine (2) is then indexed forward.

It is preferable that each vial (1) is weighed before and after filling as described because the diference between fill weights that must be detected is less than the likely difference in vial (1) weights. Preferably also each vial is weighed each time on the same weigh cell (8) so that variations between weigh cells (8) will have no effect on the accuracy of the measurement.

Drying (Step I): The apparatus for drying the shell frozen material (7) is more particularly shown in FIGS. 17 to 20.

The vials (1) pass through the vacuum tunnel (10*a*, 10*b*, 11) from the rear to the front. The vacuum tunnel (10*a*, 10*b*, 11) comprises a sealed vacuum drying chamber (11) and airlock chambers (10*a*, 10*b*) at the rear and front end of the drying chamber (11). Each airlock (10*a*, 10*b*) has an inner (13*a*, 13*b*) and outer (12*a*, 12*b*) door. The magazine (2) enters the front air lock (10*a*) between the FSF chamber (5) and a vacuum drying chamber (11). The outer door (12*a*) of the first airlock (10*a*) then closes and the air pressure is reduced to the same as the vacuum drying chambers (11). The inner door (13*a*) of the front airlock (10*a*) then opens and the magazine (2) enters the vacuum drying chamber (11) The inner door (13*a*) is then closed, the outer door (12*a*) of the front airlock (10*a*) then opens ready for the next magazine (2)

Figure 18:
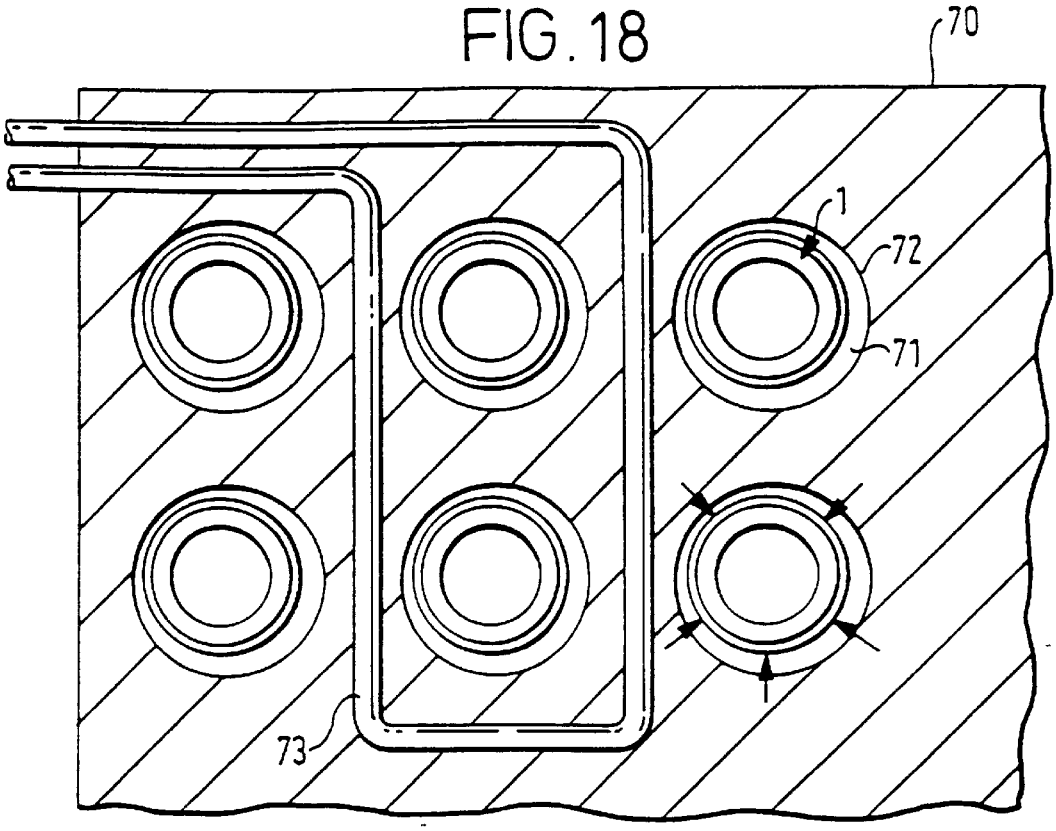
FIG. 18 is a cross-sectional plan view through a portion of a heating block used for drying the frozen material in the vials.

A conveyor means (not shown) preferably of the same roller conveyor arrangement (25 to 36) in the FSF chamber (5) is provided for moving the magazines (2) of vials (1) through the vacuum tunnel (10*a*, 10*b*, 11) . A series of heater blocks (70) are spaced along the length of the vacuum chamber (11) above the conveyor means (25 to 36) and magazines (2). As shown more particularly in FIG. 18 (which shows the plan view of a portion of a heater block (70) and vials), the heating blocks (70) comprise a plurality of tubular heating chambers (71) corresponding to the number of vials (1) in each magazine (2). Each chamber (71) is defined by a tubular wall (72) which extends to a height just above the top of the vial (1), and the heating chamber (71) is optionally provided with a top (72) which optionally may have an aperture (73) communicating with the drying chamber (11), to release water vapour from the chamber (71) (FIG. 1). In the embodiment of FIG. 2, there is no aperture in the top of each heating chamber (71) but the vial (1) is inverted and water vapour escapes through the locating aperture (3) of the magazine (2). The lower end of each heating chamber is open to receive the vial (1). The heating blocks (70) are moveable vertically from a first position above the magazines (2) to a second position in which they are lowered so that the base of the heating block (70) rests on or near to the upper surface of the magazine (2) such that each vial (1) fits snugly into a heating chamber (71) In the embodiment of FIG. 18, a small space is left between the body of each vial (1) and the inner walls (72) of the corresponding heating chamber (71). In this position heat can pass radially inwards from the heating block to the shell frozen material (7) over a substantial area of the shell (7) in the direction of the arrows (FIG. 18). The heat is transferred by radiation and by conduction and convection through the residual gas which exists in the (vacuum) heating chamber (71). The vacuum space between the heating chamber wall (72) and the body of the vial is important in that it has an effect on how efficient heat is transferred to the shell (7) of material. Preferably the proximity of the heating wall and vial (1) is about 5 mm or less, more preferably about 3 mm or less. In the embodiment shown the proximate distance is about 1 mm.

The heater block (70) is constructed of a good thermally conducting material. Aluminium, for example, is suitable providing it is treated to prevent the production of particles caused by surface oxidation for example by anodising. The temperature of the heater block (70) can be maintained by the passage of heating fluid through an element or pipe (73) attached to, or a conduit (73) running through the heating block (70).

Although the heating block (70) passes heat into the vials (1), it will sometimes be necessary for the block (70) to be cooled in order to maintain correct temperature (if for example the heat gain from ambient to the block (70) is greater than the heat lost from the block (61) to the vials (1). (Cooling is also needed at the start of a batch). For this reason the blocks (70) are controlled by a fluid which can be heated or cooled and not just by an electrical heater element. In particular during primary drying the vials (1) may be at −50° C. and the heater blocks at −20° C.

Figure 19:
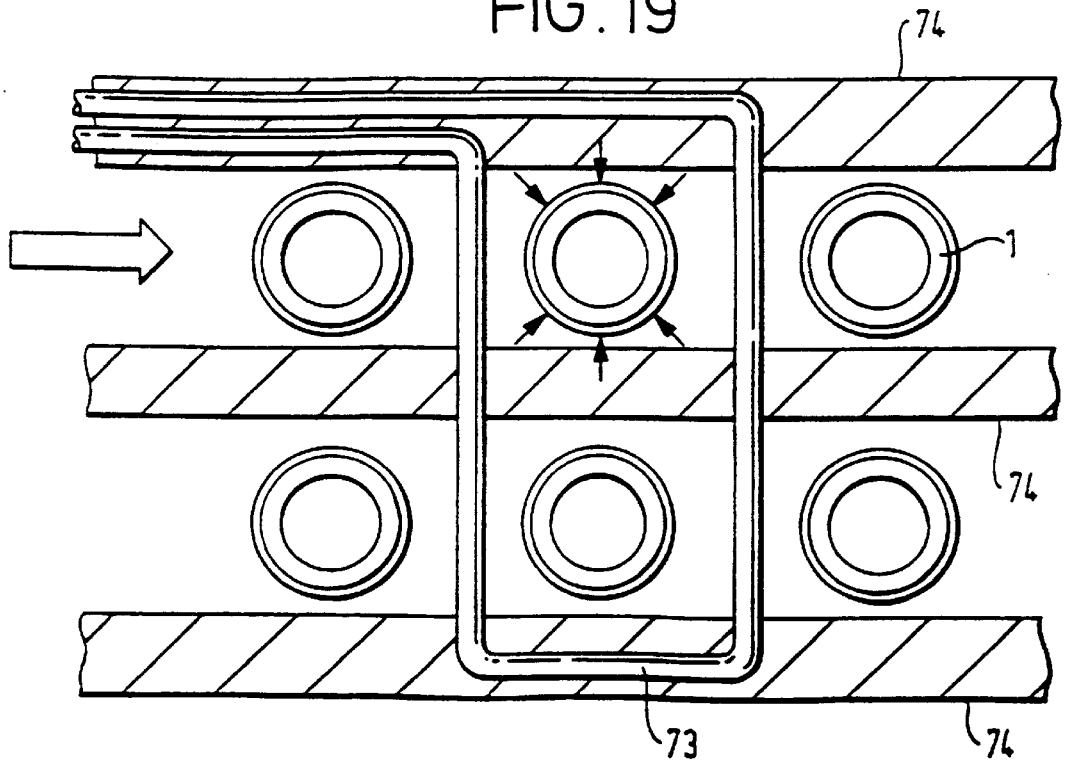
FIG. 19 is a cross-sectional plan view through heating walls which are an alternative embodiment to the blocks of FIG. 15 for drying the frozen material in the vials.

FIG. 19 shows an alternative heating means to the heating blocks (70) of FIG. 18. In this embodiment long heating walls (74) are provided running in parallel along each side of and down the middle (longitudinally) of the conveyor means (25 to 36) on which the magazines (2) rest. Each wall (74) is approximately the same height as the vials (1) when they are resting on the magazine (2). As with the heating blocks, the heating walls are preferably controlled by circulating a thermal liquid through an element (73) running through or attached to the walls (74). The walls (74) consist of separate sections, the temperature of which progressively increases along the vacuum chamber (11) in the direction of the large arrow such that the temperature experienced by the shell frozen material (7) in each vial (1) progressively increases as it moves axially along the drying chamber (11). The thermal pathway for heat transfer is again radially inwards (as shown) by the arrows from the heating walls to the shell frozen material (3) over a substantial area of the shell, thereby drying the shell (7) much quicker than previous methods in the art. Again the heat transfer will be by a combination of conduction or convection and radiation in the vacuum space between the heating walls (74) and the vials (1). As before the proximity between the heating walls (74) and body of the vials is preferably 5 mm or less, more preferably about 3 mm or less.

The difference between the heating embodiments of FIGS. 18 and 19 is that the vial (1) is passed between two heating walls (74) instead of being received into a heating chamber (70). As a consequence, it is no longer necessary to lift the heating blocks to allow the vials (1) to move and therefore the embodiment of FIG. 19 lends itself to a more simplified design. The disadvantage, however, is the longer thermal pathway and less efficient heat transfer from the heating walls (74) to the shell (7). By substantially enclosing the vial with the heating means, such as with the heating chamber (71) of the heating block (7), a faster drying time is achieved.

Figure 20:
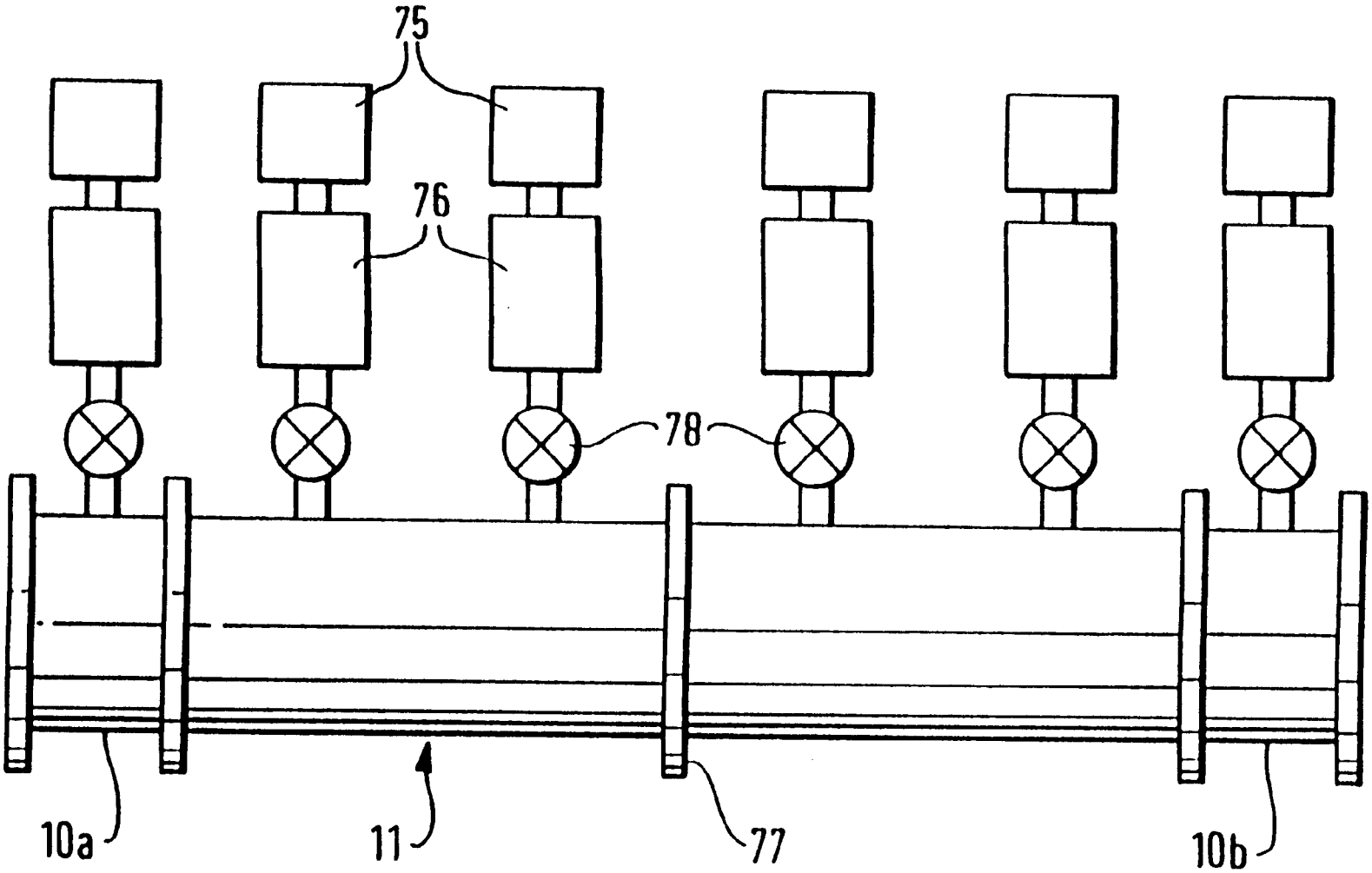
FIG. 20 is a plan view of the drying vacuum tunnel using the drying apparatus.
Figure 9:
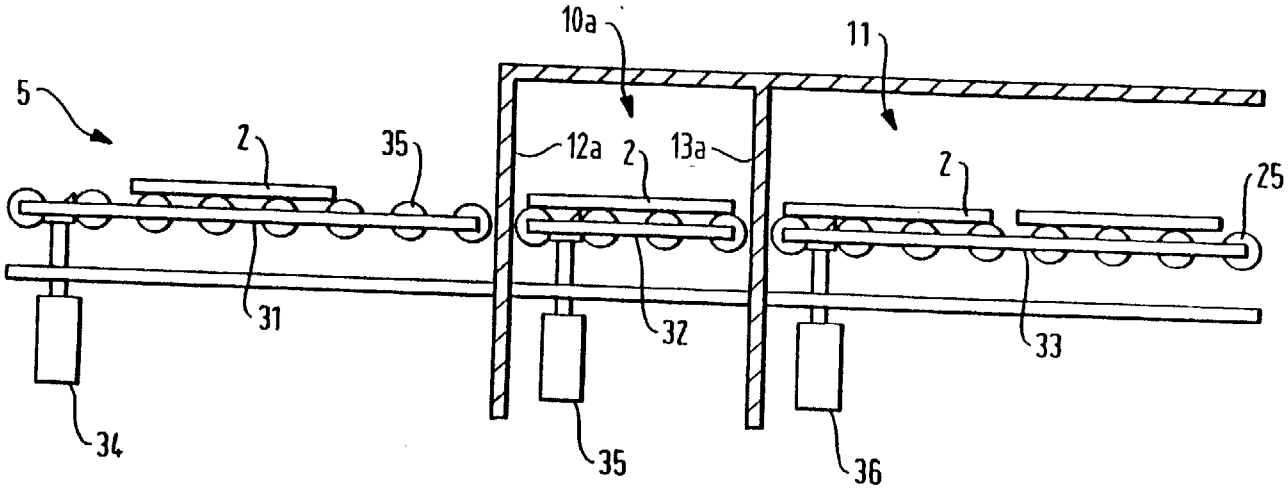
Figure 14:
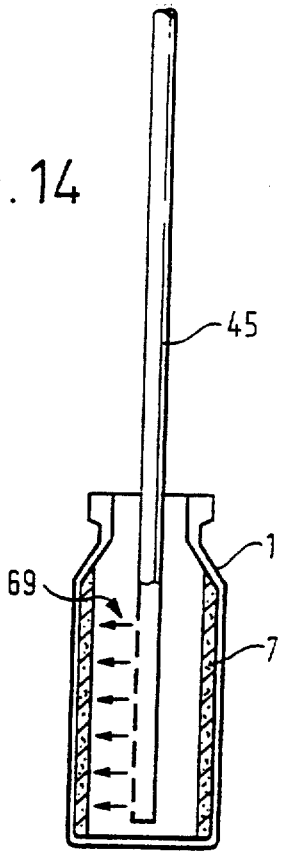
Figure 16:
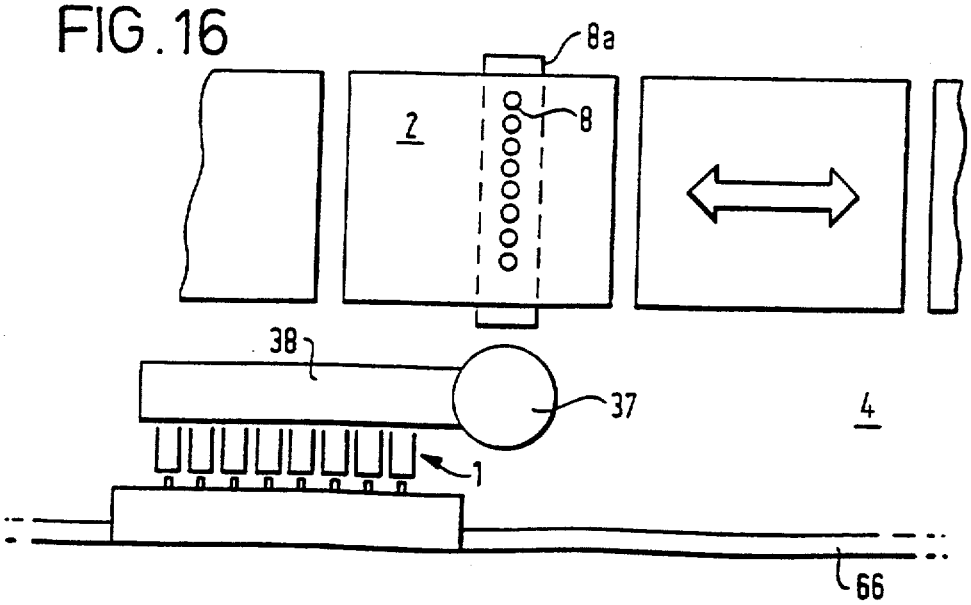
Figure 18:
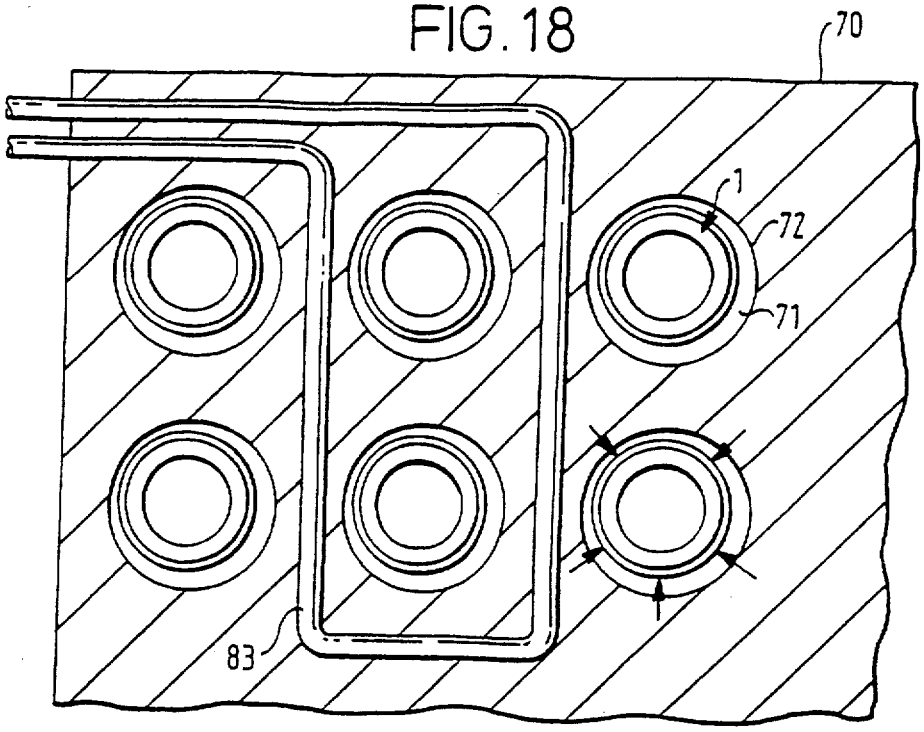
Figure 19:
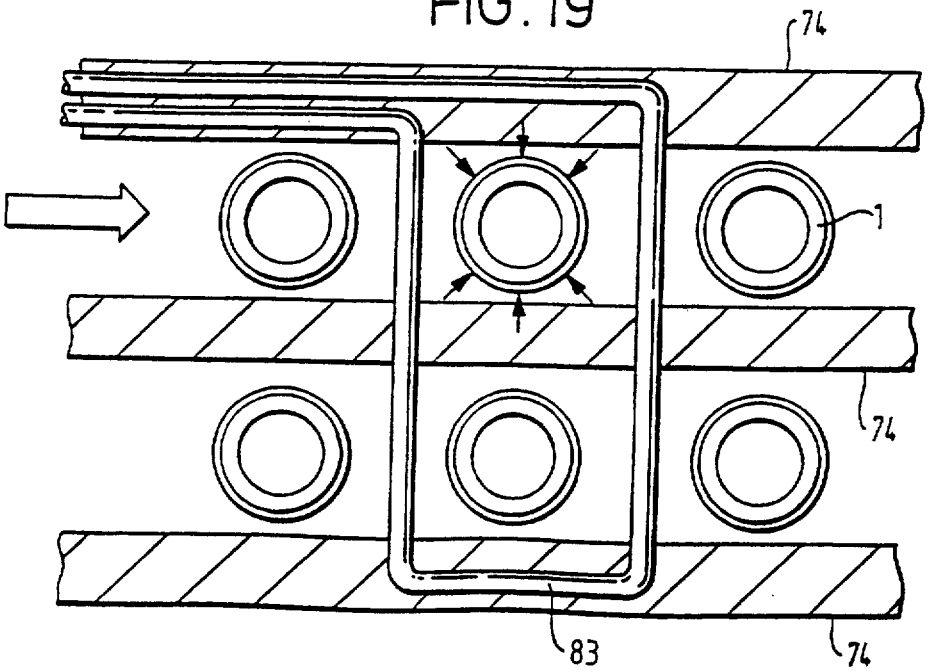

With both the heating block (70) and heating walls (74), because the heaters are individually temperature controlled, product passing along the tunnel are exposed to a drying cycle, such as for example: 1 hour at −25° C., ½ hour at +5° C., ½ hour at +5° C., ½ hour at +40° C., and ½ hour at +40° C., FIG. 20 shows in plan view the arrangement of vacuum pumps and condensers on the side of the vacuum chamber (11) and air locks (10*a*, 10*b*). There is a separate vacuum pump (75) and condenser (76) for each air lock (10*a*, 10*b*) and multiple vacuum pumps (75) are disposed along the length o: the tunnel. The vacuum will become progressively higher along the length of the tunnel (10*a*, 10*b*, 11) as the product becomes progressively more dry. Isolating doors (77) can therefore be provided at intermediate positions in the tunnel to isolate a vessel, if it is found that product is sensitive to the degree of vacuum which is applied during secondary drying.

The condensers (76) will become progressively covered with ice as more product passes down the tunnel. For the purpose of defrosting, the product on run can be interrupted but preferably there should be a surplus of condensing capacity such that each condenser (76) can be isolated by means of the valve (78) for defrosting after which time it can be put back into service without interruption of production.

In both of the illustrated embodiments (FIGS. 18 and 19) of the heating means (i.e. using the heating blocks (61) and heating walls (67)), the heat passes radially inwards from the heating means to the shell frozen material in each vial. As a result the product is dried much quicker than conventional drying apparatus where the vial rests on a heated shelf (and thus only the base is heated directly). In this case heat passes axially upwards from the base through the glass walls causing a temperature gradient that increases the time required to dry the shell (7). Furthermore, because of the efficient heat transfer conditions, the drying process and apparatus of the invention is less energy demanding than the previous process.

We claim:

1. A process for carrying out freeze drying of liquid material in a vessel, in which vessels are moved automatically through various process stages up to and including being subjected to vacuum drying conditions, said process stages comprising:

(a) loading racks with vessels to be filled, such that said vessels are held apart at individual locations in the racks, each said vessel comprising a vessel base and a vessel wall having an outer surface and an inner surface;

(b) washing the vessels and racks, said vessels being in an inverted position so that washing water will drain therefrom;

(c) sterilising the vessels and racks;

(d) filling the vessels with liquid material to be frozen therein;

(e) rotating the vessels containing the liquid material to be frozen at a speed not less than that required to maintain the liquid in a shell of substantially uniform thickness against the inner surface of the vessel wall by the action of centifugal force while subjecting the liquid material to freezing conditions sufficient to freeze the material as said shell, wherein vessels are removed from the racks and are rotated remote from the racks and after a preset time to complete freezing, the rotating is stopped and the vessels are returned to the racks; and f) moving the racks with the vessels containing the material that has been frozen held at individual locations into and through a vacuum drying chamber to dry the material that has been frozen.

2. A process as claimed in claim 1 wherein during stage (d), the liquid material is introduced into each vessel while the vessel is rotating, the rotation being maintained during stage (e).

3. A process as claimed in claim 1 wherein during stage (e) each vessel is rotated about a longitudinal axis thereof while being held in a substantially horizontal position.

4. A process as claimed in claim 1 wherein the liquid material to be frozen is an aqueous drug and each vessel is a vial of about 10 to 40 mm in diameter and carries at least one unit dose of drug.

5. A process as claimed in claim 1 wherein during stage (e), said freezing conditions are achieved by injecting a freezing gas into each vessel.

6. A process as claimed in claim 5 wherein the gas is nitrogen gas at about −50° C.

7. A process as claimed in claim 1 wherein during stage (e), the freezing conditions are maintained for 40 to 90 seconds.

8. A process as claimed in claim 1 wherein during stage (e), each vessel is rotated at about 2500 to about 3500 revolutions per minute.

9. A process as claimed in claim 1 further including a first weighing step wherein each vessel is weighed while empty in the rack and a second weighing step wherein each vessel is weighed after the material has been frozen therein, to check that a correct amount of material has been frozen within the vessel.

10. A process as claimed in claim 1 wherein during stage (f), within the vacuum drying chamber, heat is applied radially inwardly from a heater over a substantial surface area of the shell of the material that has been frozen in each vessel.

11. A process as claimed in claim 10 wherein a distance between the heater and the shell of the material that has been frozen is 5 mm or less.

12. A process as claimed in claim 1 wherein during stage (b) the vessels are washed by injecting washing water up through the racks and into the vessels.

13. A process as claimed in claim 1 wherein the vessels are loaded upside-down onto the rack in stage (a) so as to be disposed in an inverted position and are then subsequently washed and sterilised in said inverted position.

14. A process as claimed in claim 13 wherein the vessels are removed from the racks prior to stage (d) and returned to the racks in said inverted position after stages (d) and (e), and are then turned so as to be upside-up onto a rack before stage (f).

15. A vessel having a vessel wall with an inner surface and an outer surface and having a lyophilised material formed as a shell on the inner surface of the vessel wall, said shell being produced by the process of claim 1.

16. Apparatus for freeze-drying a liquid material contained in a sterilised vessel having a vessel base and vessel wall with an inner surface and an outer surface so that said liquid material forms a shell of substantially uniform thickness on the inner surface of said vessel wall and in which a plurality of said vessels are moved automatically through various process stages up to and including being subjected to vacuum drying conditions; said apparatus comprising:

racks which include individual locations for locating vessels such that they are held apart;

a washer for washing and a steriliser for sterilising the vessels and racks;

rotatable grippers for removing the vessels from the racks and returning the vessels to the racks, and for holding a vessel and rotating said vessel about a longitudinal axis thereof at a high speed so as to maintain liquid material against the inner surface of the vessel wall by centrifugal force;

filling means connected to a liquid material supply for introducing liquid material into the vessel;

freezing means for freezing the liquid material in the form of a shell of substantially uniform thickness against the inner surface of the vessel wall;

a vacuum drying chamber containing a heater; and a conveyor to move racks holding the vessels containing the material that has been frozen into and through the vacuum drying chamber, and to move subsequent racks loaded with vessels into position for filling and freezing.

17. Apparatus as claimed in claim 16 wherein the means for freezing the liquid material includes an elongate nozzle cooperating with a connector for connecting to a gas supply, the nozzle being inserted through a neck of each vessel while the vessel is rotating to introduce the gas into the vessel.

18. Apparatus as claimed in claim 17 wherein the elongate nozzle is provided with a plurality of ports along a length thereof through which the gas is injected.

19. Apparatus as claimed in claim 16 wherein the filling means is a filling nozzle cooperating with a connector for connecting to a liquid material supply, the filling nozzle being inserted through a neck of the vessel to introduce liquid material into the vessel.

20. Apparatus as claimed in claim 16 which further includes a movable elongate arm located adjacent the conveyor, filling means, and freezing means, said elongate arm having a plurality of rotatable grippers equispaced along a length thereof, said elongate arm being adapted to move a plurality of vessels held in the plurality of grippers from the conveyor to the filling means and freezing means.

21. Apparatus as claimed in claim 20 wherein the elongate arm is moveable vertically from a first position in which the plurality of grippers are substantially perpendicular to and spaced above the conveyor, to a second position approximately one vessel length from the conveyor so as to take hold of a respective plurality of vessels, and a third position adjacent the filling means and freezing means for filing the vessels with liquid material and freezing the liquid material in the vessels.

22. Apparatus as claimed in claim 21 wherein a robotic handler is coperably connected to the elongate arm to control and move the arm, said handler being fixedly located adjacent the conveyor, and filling means and freezing means such that the arm can swing through substantially 90° in a substantially horizontal plane between said first position in which the arm and plurality of rotatable grippers are substantially perpendicular to the conveyor and the third position in which the elongate arm and rotatable grippers are disposed substantially parallel to and to the side of the conveyor and adjacent the filling and freezing means ready for filling and freezing.

23. Apparatus as claimed in claim 16 wherein each of the plurality of rotatable grippers comprises a drive shaft, an outer casing, fingers connected to a base and axially movable into and out of said casing, resilient means, complementary projections and recesses provided on the outer wall of the fingers and on the inner wall of said casing, such that the fingers are moved axially outwardly of the casing in opposition to the resilient means and said projections are received into said recesses thereby allowing the fingers to open and to release a vessel, and are moved inwardly of said casing by said resilient means, said projections and recesses sliding out of engagement thereby closing the fingers around a vessel.

24. Apparatus as claimed in claim 22 wherein the grippers is provided with a drive shaft and further including a rotatable driver comprising a drive motor and a drive belt, said drive belt extending round the drive shaft and drive motor so as to rotate the gripper.

25. Apparatus as claimed in claim 16 wherein the conveyor comprises parallel side support members;

a plurality of parallel shafts suspended between the support members;

rotatable rollers mounted on the shafts to support the racks;

and a driver to drive the racks along the rollers.

26. Apparatus as claimed in claim 25 wherein the driver includes rotatable gear wheels mounted on shafts along the conveyor, so as to grip a base of the rack resting on the rollers and move the rack along the conveyor.

27. Apparatus as claimed in claim 16 wherein each rack comprises a tray having upper and lower surfaces and having equispaced location apertures extending through the tray for locating the vessels, at least one air flow aperture, and at least one abutment adjacent each location aperture which trace a circumference of the vessel base about a vertical axis of the locating aperture to form a locating flange on which the vessel can be located in an upright position.

28. Apparatus as claimed in claim 26 wherein teeth are provided on the base of the rack for engaging with the gear wheels.

29. Apparatus as claimed in claim 16 wherein the heater within the vacuum drying chamber directs heat radially inwardly from the heater to the shell of the material that has been frozen.

30. Apparatus as claimed in claim 29 wherein the heater is a heating block having at least one heating chamber for receiving and extending substantially round the whole circumference of the vessel, an inner wall of said heating chamber emitting heat radially inwardly to the shell of the material that has been frozen.

31. Apparatus as claimed in claim 29 wherein the heater comprises a series of heating blocks, each maintained at a different temperature and spaced from one another along a length of the vacuum chamber, such that as racks of vessels are moved along the chamber by the conveyor, the vessels are heated by successive heating blocks to successively higher temperatures to thereby dry the shell of the material that has been frozen within the vessels.

32. Apparatus as claimed in claim 31 wherein the heater comprises parallel heated walls extending substantially along a length of the conveyor and directing heat to the shell of the material that has been frozen such that the shell of material that has been frozen is dried as the racks with the vessels move along the conveyor between the heated walls.

33. Apparatus as claimed in claim 29 wherein the heater has one of conduits extending therethrough and elements attached thereto for carrying a liquid to control a temperature of the heater.

34. Apparatus as claimed in claim 29 wherein walls of the heater are at a distance of 5 mm or less from the outer surface of the vessel wall during a drying cycle.

* * * * *

UNITED STATES PATENT AND TRADEMARK OFFICE

CERTIFICATE OF CORRECTION

PATENT NO. : 5,964,043
DATED : October 12, 1999
INVENTOR(S) : OUGHTON et al

It is certified that error appears in the above-identified patent and that said Letters Patent is hereby corrected as shown below:

On the Title Page, in the [30] Foreign Application Priority Data

"[DE] Germany" should be - -[GB] Great Britain- -.

IN THE DRAWINGS:

Attached Pages should be substituted for the corresponding pages of Figures in the patent.

In column 8, line 62, "rain" should be - -drying- -.

Figure 3:
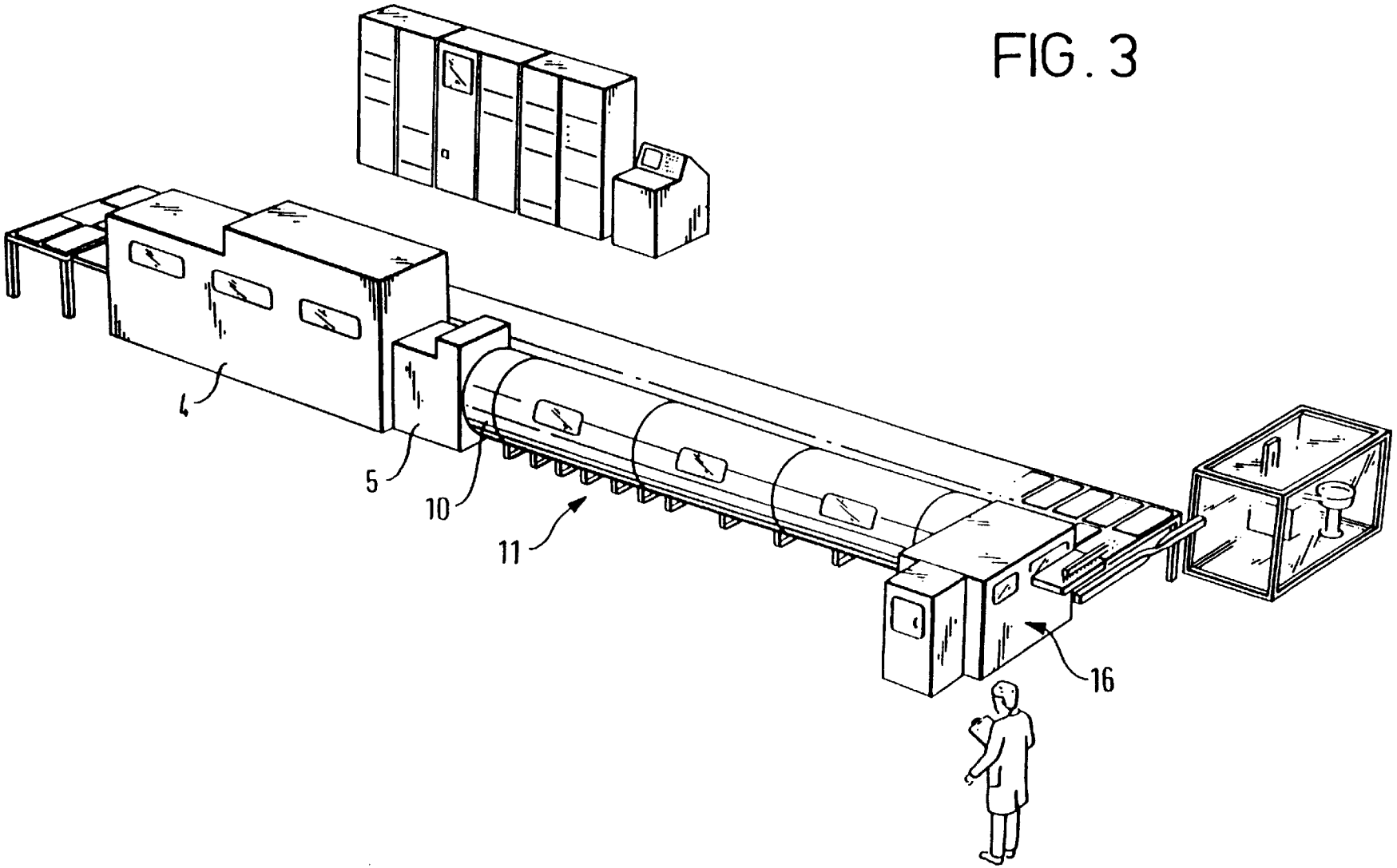
FIG. 3 is a top and side perspective view of the apparatus shown schematically in FIG. 1.

In column 9, line 11, "FIG. 4" should be - -FIG. 3- -.

Figure 10:
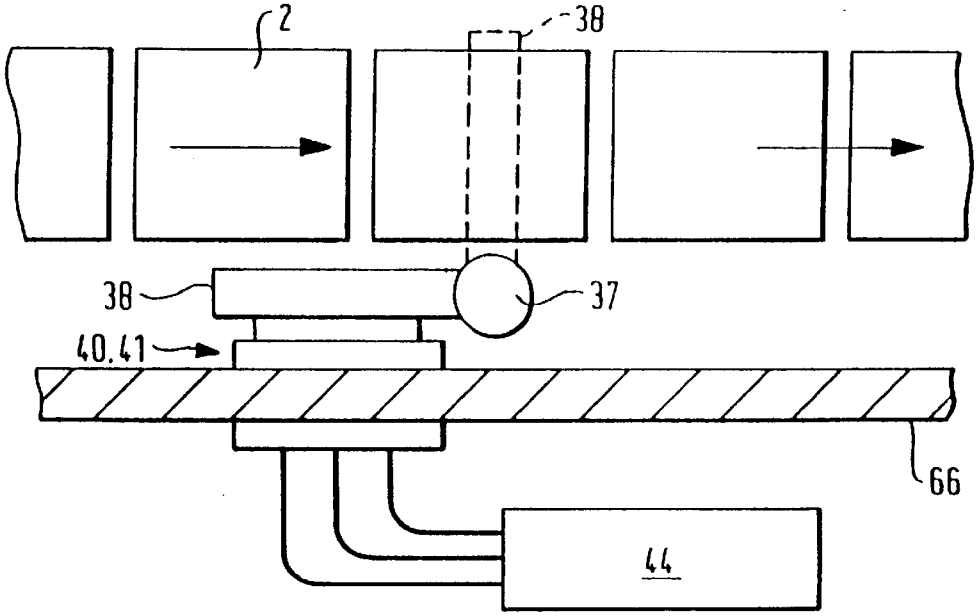
FIG. 10 is a plan view of part of the filling and freezing apparatus shown in FIG. 8.

In column 11, line 9, "(S)" should be - -(5)- - ;

line 14, "(S)" should be - -(5)-- ;

line 25, "FIG. 9" should be - -FIG. 10- -;

line 29, "(40)" should be --(41)--.

line 30, "(41)" should be --(40)--.

line 63, "(42)" should be - -(48)- - and "(43)" should be - -(49)- -;

line 67, "(53)" should be - -(54)- -.

UNITED STATES PATENT AND TRADEMARK OFFICE

CERTIFICATE OF CORRECTION

PATENT NO. : 5,964,043
DATED : October 12, 1999
INVENTOR(S) : OUGHTON et al

It is certified that error appears in the above-identified patent and that said Letters Patent is hereby corrected as shown below:

In column 13, line 44, "(42)" should be - -(45)- -;

line 49, "from gas to" should be - -away from- -;

line 54, "(42)" should be - -(45)- -.

In column 15, lines 39 and 40, "(73)" should be - -(83)- -;

line 46, "(61)" should be - -(70)- -;

line 60, "(73)" should be - -(83)- -.

In column 16, line 2, "(3)" should be - -(7)- -;

line 33, "o:" should be - -of- -;

line 42, "product on" should be - -production- -;

line 48, "(61) should be - -(71)- -;

line 49, "(67)" should be - -(74)- -.

Signed and Sealed this

Fifth Day of December, 2000

*Attest:*

*Attesting Officer*

Q. TODD DICKINSON

*Director of Patents and Trademarks*